US010843839B2

(12) United States Patent
Nishimura et al.

(10) Patent No.: US 10,843,839 B2
(45) Date of Patent: Nov. 24, 2020

(54) LABEL-AFFIXING MACHINE AND STRETCH-WRAPPING MACHINE

(71) Applicant: Ishida Co., Ltd., Kyoto (JP)

(72) Inventors: Hiromu Nishimura, Ritto (JP); Susumu Kimoto, Ritto (JP); Hiroaki Tokura, Ritto (JP); Mitsunobu Hayashi, Ritto (JP); Yuuki Tai, Ritto (JP)

(73) Assignee: Ishida Co., Ltd., Kyoto (JP)

( * ) Notice: Subject to any disclaimer, the term of this patent is extended or adjusted under 35 U.S.C. 154(b) by 40 days.

(21) Appl. No.: 16/075,768

(22) PCT Filed: Feb. 2, 2017

(86) PCT No.: PCT/JP2017/003742

§ 371 (c)(1),
(2) Date: Aug. 6, 2018

(87) PCT Pub. No.: WO2017/138425

PCT Pub. Date: Aug. 17, 2017

(65) Prior Publication Data

US 2019/0047738 A1 Feb. 14, 2019

(30) Foreign Application Priority Data

Feb. 8, 2016 (JP) ..... 2016-021965

(51) Int. Cl.

| | |
|---|---|
| ***B65C 9/30*** | (2006.01) |
| ***B65C 9/42*** | (2006.01) |
| ***B65C 9/08*** | (2006.01) |
| ***B65C 1/02*** | (2006.01) |
| ***B65C 9/18*** | (2006.01) |

(Continued)

(52) U.S. Cl.

CPC ..... *B65C 9/30* (2013.01); *B65B 11/008* (2013.01); *B65C 1/021* (2013.01); *B65C 1/025* (2013.01);

(Continued)

(58) Field of Classification Search

CPC ..... B65C 1/021; B65C 1/025; B65C 9/00065; B65C 9/02; B65C 9/08; B65C 9/18;

(Continued)

(56) References Cited

U.S. PATENT DOCUMENTS

2003/0053139 A1 3/2003 McKim
2006/0272283 A1* 12/2006 Kawanishi ..... B65B 11/54 53/51
2016/0159511 A1* 6/2016 Hyca ..... B65C 9/1876 156/152

FOREIGN PATENT DOCUMENTS

DE 102007034698 A1 1/2009
JP 62216772 A * 9/1987

(Continued)

OTHER PUBLICATIONS

Translation JP-H09-300788-A, Nov. 1997, JP, Watanabe, Tetsuji (Year: 1997).*

(Continued)

*Primary Examiner* — George R Koch
(74) *Attorney, Agent, or Firm* — Studebaker & Brackett PC

(57) ABSTRACT

A label-affixing machine affixes a label, which is conveyed by a label conveying body, to the back surface of a product being conveyed. The label-affixing machine includes a label holding unit configured to hold a label so that an adhesive surface of the label faces outward, a pressing mechanism configured to press a label conveying body, which is disposed on a side facing the label holding unit, against the adhesive surface of the held label by moving the label conveying body toward the label holding unit, and a controller that controls the drive of the label conveying body and the pressing mechanism to affix the label to the back surface of the product.

10 Claims, 15 Drawing Sheets

(51) Int. Cl.

| | |
|---|---|
| ***B65C 9/34*** | (2006.01) |
| ***B65B 11/00*** | (2006.01) |
| ***B65C 9/00*** | (2006.01) |
| ***B65C 9/02*** | (2006.01) |
| ***B65C 9/46*** | (2006.01) |

(52) U.S. Cl.
CPC ..... *B65C 9/0065* (2013.01); *B65C 9/02* (2013.01); *B65C 9/08* (2013.01); *B65C 9/18* (2013.01); *B65C 9/1803* (2013.01); *B65C 9/34* (2013.01); *B65C 9/42* (2013.01); *B65C 9/46* (2013.01)

(58) Field of Classification Search
CPC ..... B65C 9/1803; B65C 9/30; B65C 9/32; B65C 9/34; B65C 9/40; B65C 9/42; B65C 9/46; B65B 11/008
See application file for complete search history.

(56) References Cited

FOREIGN PATENT DOCUMENTS

| | | | |
|---|---|---|---|
| JP | 09300788 | A * | 11/1997 |
| JP | 2001151214 | A | 6/2001 |
| JP | 2005212823 | A | 8/2005 |
| JP | 2005-335727 | A | 12/2005 |
| JP | 2009-161224 | A | 7/2009 |
| JP | 2010-120663 | A | 6/2010 |
| JP | 4619571 | B2 | 1/2011 |
| JP | 2015-034050 | A | 2/2015 |

OTHER PUBLICATIONS

Translation JP-S62-216772-A, Sep. 1987, JP, Watanabe, Toshiyuki (Year: 1987).*

Translation JP-2009-161224-A, Jul. 2009, JP, Takashi, Kimura (Year: 2009).*

International Search Report issued in corresponding International Application No. PCT/JP2017/003742; dated May 9, 2017.

International Preliminary Report on Patentability issued in corresponding International Application No. PCT/JP2017/003742; dated Aug. 23, 2018.

The extended European search report issued by the European Patent Office dated Oct. 7, 2019, which corresponds to European Patent Application No. 17750149.1-1017 and is related to U.S. Appl. No. 16/075,768.

* cited by examiner

LABEL-AFFIXING MACHINE AND STRETCH-WRAPPING MACHINE

This application is a 371 of PCT/JP2017/003742, filing date Feb. 2, 2017.

TECHNICAL FIELD

The present disclosure relates to a label-affixing machine that affixes a label to the back surface of a wrapped product and a stretch-wrapping machine including the label-affixing machine.

BACKGROUND ART

A label-affixing machine disclosed in the following Patent Literature 1 is known as a label-affixing machine that affixes a label to the back surface of a product. As illustrated in FIG. 14, the label-affixing machine disclosed in Patent Literature 1 includes: a conveyor 2 configured to convey a product 1; label holding means 5 for holding a label 4 issued from a label printer 3; label conveying means 6 for conveying the label 4, which is received from the label holding means 5, toward the back surface of the product 1; and delivery means 7 for delivering the label 4, which is held by the label holding means 5, to the label conveying means 6 so that the label 4 conveyed by the label conveying means 6 joins the product 1.

The label printer 3, which is used here, issues a label 4 while separating the label 4 from a mount 41 so that the adhesive surface of the label 4 faces the label conveying means 6. The issued label 4 is held by the label holding means 5 that sucks the label 4. Then, when a product 1 being conveyed reaches a predetermined position, a solenoid 71 as the delivery means 7 is operated on the basis of a label detection signal of a sensor (not illustrated) and the label 4 held by the label holding means 5 is moved to a position, which is illustrated by a chain line, from a position, which is illustrated by a solid line, by the solenoid 71 so that the held label 4 is delivered to the label conveying means 6.

The delivered label 4 is conveyed upward in a state in which the adhesive surface of the delivered label 4 is affixed to string belts 61 of the label conveying means 6. Accordingly, the delivered label 4 joins the product 1 being conveyed and is affixed to the back surface of the product 1.

CITATION LIST

Patent Literature

Patent Literature 1: Japanese Patent No. 4619571

SUMMARY OF INVENTION

Technical Problem

Incidentally, in a case in which the product is a packed lunch, side dishes, or the like, raw materials and additives are printed on the label, which is to be affixed to the back surface of the product, and a cooking method or the like is printed on the label sometimes. The amount of printing of them varies depending on the product. For this reason, in a case in which a label with a mount where labels having a fixed size are affixed to a mount at a fixed pitch is used, there is a problem that the size of a label should be changed according to the amount of printing.

In contrast, in the case of a mountless label where a long label sheet is cut into a length corresponding to the amount of printing to form a label, the length of a label can be freely changed according to the amount of printing. Accordingly, the mountless label is preferred as a label to be affixed to the back surface of a product.

However, there is a problem that a mountless label cannot be used in the label-affixing machine disclosed in Patent Literature 1. The reason for this is as follows: as illustrated in FIG. 15, in the case of a mountless label, a label sheet 42 fed from the label printer 3 is held between a pair of rollers 8 and is cut by a cutter 9, and a label 4 is held in this state. Accordingly, when the label 4 is to be moved toward the label conveying means 6, the label 4 is hindered by the rollers 8 and cannot be delivered to the label conveying means 6.

Accordingly, a method of feeding the cut label 4 from the rollers 8 by rotationally driving the pair of rollers 8 is also considered. However, even in this case, the rear end portion of the label 4 getting out of the rollers 8 remains at a position where the rear end portion of the label 4 interferes with the rollers 8. For this reason, when the label 4 held by the label holding means 5 is to be moved toward the label conveying means 6, there is another problem that the posture of the label 4 is lost since the adhesive surface of the label 4 comes into contact with the rollers 8.

The disclosure has been made to solve the above-mentioned problems, and an object of the disclosure is to provide a label-affixing machine that can use not only a label with a mount but also a mountless label and a stretch-wrapping machine on which the label affixing machine is mounted.

Solution to Problem

A label-affixing machine according to an aspect of the disclosure is a label-affixing machine that affixes a label, which is conveyed by a label conveying body, to a back surface of a product being conveyed. The label-affixing machine includes: a label holding unit configured to hold the label so that an adhesive surface of the label faces outward; a pressing mechanism configured to press a label conveying body, which is disposed on a side facing the label holding unit, against the adhesive surface of the held label by moving the label conveying body toward the label holding unit; and a controller that controls drive of the label conveying body and the pressing mechanism to affix the label to the back surface of the product.

In the label-affixing machine, the label conveying body can be pressed against the adhesive surface of the label and the label 4 can be moved just as it is in that state in the direction where the label is issued. Accordingly, even though not only a label with a mount is used but also a mountless label is used, the label can be affixed to the back surface of the same product.

In the label-affixing machine according to the aspect of the disclosure, the controller may control the drive of the label conveying body and the pressing mechanism to allow the label conveying body to be away from the label holding unit while the label is issued and, once the issuing of the label ends, to press the label conveying body against the adhesive surface of the held label.

In the label-affixing machine according to the aspect of the disclosure, the controller may control the drive of the label conveying body and the pressing mechanism to allow the label conveying body to travel upward in a state in which the label conveying body is away from the label holding unit while the label is issued and, once the issuing of the label ends, to allow the label conveying body to stop after pressing the label conveying body against the adhesive surface of the issued label. Accordingly, it is possible to inhibit the curled front end portion of the label from being folded so that the adhesive surface of the label faces inward.

The label-affixing machine according to the aspect of the disclosure may further include a remaining amount detection unit for a label roll that is loaded into a label printer. In a case in which a detected remaining amount is equal to or smaller than a predetermined value, the controller may control the drive of the label conveying body and the pressing mechanism to allow the label conveying body to travel in a state in which the label conveying body is away from the label holding unit while the label is issued and, once the issuing of the label ends, to allow the label conveying body to stop after pressing the label conveying body against the adhesive surface of the issued label. Accordingly, it is possible to inhibit the curled front end portion of the label from not being sucked.

In the label-affixing machine according to the aspect of the disclosure, in a case in which the length of the label in a direction where the label is issued is equal to or smaller than a predetermined value, the controller may control the drive of the label conveying body and the pressing mechanism to allow the label conveying body to travel upward in a state in which the label conveying body is away from the label holding unit while the label is issued and, once the issuing of the label ends, to allow the label conveying body to stop after pressing the label conveying body against the adhesive surface of the issued label. Accordingly, it is possible to inhibit the curled front end portion of the label from floating.

In the label-affixing machine according to the aspect of the disclosure, the label printer, which issues the label, may include a cutter configured to cut a label sheet into a length corresponding to the amount of printing. The pair of rollers 8 (see FIG. 15) of the related art is not necessary.

In the label-affixing machine according to the aspect of the disclosure, the controller may control the pressing mechanism to press the label conveying body against an adhesive surface of the label sheet to be cut before the label sheet is cut. Accordingly, the label, which is cut and separated from the label sheet, is affixed to and held by the label conveying body without causing a position deviation.

The label-affixing machine according to the aspect of the disclosure may further include a label sensor configured to detect a label to be conveyed by the label conveying body, and the controller may control the drive of the label conveying body and the pressing mechanism to allow the label conveying body to travel until the label is detected by the label sensor after the label conveying body is pressed against the adhesive surface of the label. Accordingly, even though the length of a label in the direction where the label is issued is variously changed, the front end portion of the label can be made to remain at the detection position of the label sensor.

The label-affixing machine according to the aspect of the disclosure may further include a conveyor configured to convey the product and a product detecting sensor configured to detect the product. Once the controller receives a detection signal from the product detecting sensor, the controller may allow the label conveying body to travel upward. Accordingly, when the product to be conveyed reaches the detection position of the product detecting sensor, a label, which stands by at a predetermined position, is sent and is affixed to the back surface of the product. Therefore, even though the length of the product in the conveying direction is changed, the label can be affixed to a predetermined position on the back surface of the product.

A stretch-wrapping machine according to an aspect of the disclosure includes a carry-out conveyor configured to send a wrapped product to the conveyor and the label-affixing machine, and the carry-out conveyor and the conveyor of the label-affixing machine are connected to each other through a power transmission mechanism.

In the stretch-wrapping machine, the carry-out conveyor of the wrapping machine and the conveyor of the label-affixing machine can be operated at the same speed in synchronization with each other.

Advantageous Effects of Invention

According to the disclosure, it is possible to provide a label-affixing machine that can use not only a label with a mount but also a mountless label and a stretch-wrapping machine on which the label-affixing machine is mounted.

DESCRIPTION OF EMBODIMENTS

Figure 1:
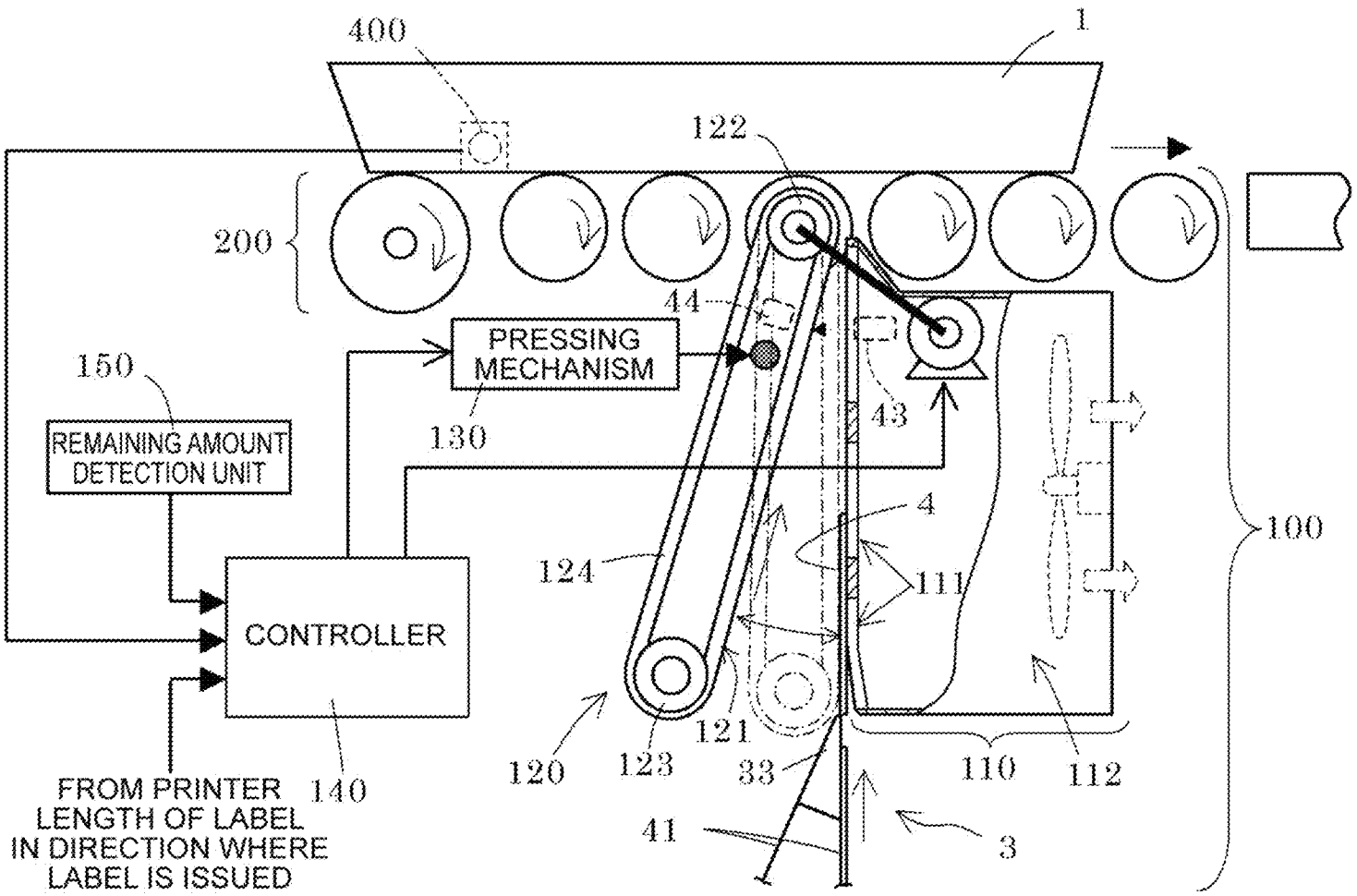
FIG. 1 is a conceptual diagram illustrating the structure of a label-affixing machine according to an embodiment in a case in which a label with a label mount is used.

Embodiments will be described in detail below with reference to the drawings. Meanwhile, the same portions or corresponding portions will be denoted in the respective drawings by the same reference numerals and the repeated description thereof will be omitted.

Figure 2:
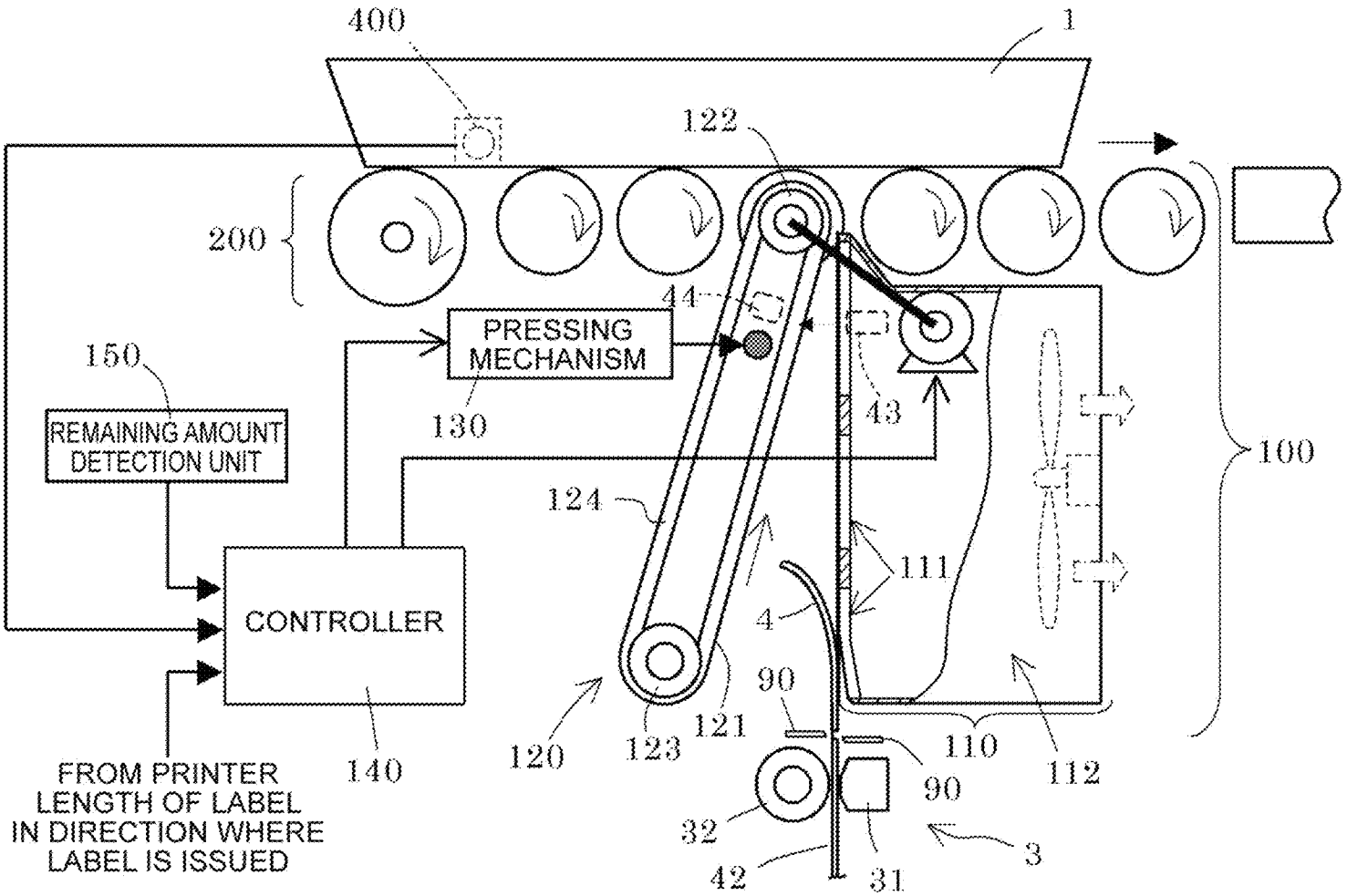
FIG. 2 is a conceptual diagram illustrating the structure of the label-affixing machine according to the embodiment in a case in which a mountless label is used.

FIGS. 1 and 2 are conceptual diagrams illustrating the structure of a label-affixing machine according to an embodiment. In FIGS. 1 and 2, the label-affixing machine 100 includes: a label holding unit 110 for sucking a label 4 issued from a label printer 3 so that an adhesive surface of the label 4 faces outward; a pressing mechanism 130 for pressing a label conveying body 121, which is disposed on the side facing the label holding unit 110, against the adhesive surface of the held label 4 by moving the label conveying body 121 toward the label holding unit 110; a conveying unit 120 for sending the label conveying body 121 to which the label 4 is affixed toward the back surface of a product 1; and a controller 140 for controlling the operation of the label conveying body 121 of the conveying unit 120 and the operation of the pressing mechanism 130 to affix the label 4 to the back surface of the product 1.

The label holding unit 110 includes a negative-pressure chamber 112 that includes a plurality of suction ports 111 provided on one surface thereof, and sucks and holds the issued label 4 by these suction ports 111. For this reason, the pressure of air in the negative-pressure chamber 112 is set to low negative pressure that allows the label 4 sucked to the suction ports 111 to be slidable along the suction ports 111 without falling in a state in which the adhesive surface of the label 4 faces outward. Further, air may be applied to the label holding unit 110 to press the issued label 4 against the label holding unit 110 even by the pressure of air.

The conveying unit 120 conveys the label conveying body 121, to which the label 4 is affixed, to the back surface of the product 1. In FIGS. 1 and 2, the label conveying body 121 includes a plurality of string belts 124 that circularly travel between a pair of upper and lower pulleys 122 and 123. However, the label conveying body 121 is not limited to such a structure, and may also be formed of a conveying body adapted so that the label 4 is conveyed without being separated but is easily separated in a direction orthogonal to the conveying direction of the label 4 in a case in which the adhesive surface of the label 4 is affixed to the conveying body, for example, like a mesh-like flat belt of which the contact area is reduced, a flat belt which a label release agent is applied to the surface thereof, or the like.

Further, in FIGS. 1 and 2, the conveying unit 120 and the label holding unit 110 are disposed to be close to each other at upper end portions thereof and to be away from each other at lower end portions thereof. However, the conveying unit 120 and the label holding unit 110 are not limited thereto, and may be disposed parallel to each other.

The pressing mechanism 130 is a mechanism for allowing the conveying unit 120 to be close to and away from the label holding unit 110 to press the label conveying body 121 against the adhesive surface of the label 4 that is held by the label holding unit 110. For this purpose, in FIGS. 1 and 2, the pressing mechanism 130 is adapted to allow the lower pulley 123 to oscillate around the horizontal rotating shaft of the upper pulley 122 to rotationally move the string belts 124 toward the label holding unit 110 in the direction of an arrow (see FIG. 1). However, the pressing mechanism 130 is not limited to this structure. Instead of this structure, the pressing mechanism 130 may have a structure in which, for example, the label holding unit 110 and the conveying unit 120 are disposed parallel to each other and the entire conveying unit 120 is moved toward the label holding unit 110 in parallel.

The controller 140 performs control for controlling the operation timing of the conveying unit 120 and the operation timing of the pressing mechanism 130 to make the label conveying body 121 be away from the label holding unit 110 while a label 4 is issued and, once the issuing of the label ends, to press the label conveying body 121 against the adhesive surface of the held label.

That is, when the label printer 3 starts printing, a label 4 to be fed from the label printer 3 is raised while being sucked to the suction ports 111 of the label holding unit 110. Then, at a timing where the issuing of the label ends, the controller 140 actuates the pressing mechanism 130 to press the string belts 124 as the label conveying body 121 against the adhesive surface of the label 4. Accordingly, the label 4 is affixed to the string belts 124. In this state, the controller 140 rotates the respective pulleys 122 and 123 to allow the string belts 124 to travel in the direction of the arrow at a timing where the product 1 being conveyed reaches the affix position of the label 4. Accordingly, the label 4, which is conveyed by the string belts 124, protrudes from a product conveying surface, the back surface of the product 1 appears, and the label 4 is affixed to the back surface of the product 1. In more detail, when the string belts 124 turn around the upper pulley 122, the label 4 protrudes upward while being separated from the string belts 124, the back surface of the product 1 being conveyed appears, and the label 4 is affixed to the back surface of the product 1.

According to the label-affixing machine 100, as described above, the label conveying body 121 is pressed against the adhesive surface of the label 4 and the label 4 is raised just as it is in that state in a direction where the label 4 is issued. Accordingly, even though not only a label with a mount is used but also a mountless label is used, the label 4 can be affixed to the back surface of the same product 1.

Incidentally, since this kind of label 4 is wound around a paper core so that an adhesive surface of the label 4 faces inward, the label 4 to be issued tends to be curled so that the adhesive surface of the label 4 faces inward. For this reason, in a case in which the label 4 is issued from the label printer 3, the front end portion of the label 4 may float without being sucked to the suction ports 111 as illustrated in FIG. 2. In a case in which the label conveying body 121 is pressed against the label 4 in this state, the curled front end portion of the label may be folded so that the adhesive surface of the label 4 faces inward. In this case, the label 4, which is normally issued, becomes a defective label. Further, in a case in which the defective label is affixed to the product 1, the normal product 1 is also treated as a defective product.

In order to solve such a problem, the controller 140 controls the drive of the pressing mechanism 130 and the label conveying body 121 to allow the label conveying body 121 to travel upward in a state in which the label conveying body 121 is away from the label holding unit 110 while a label 4 is issued and, once the issuing of the label ends, to allow the label conveying body 121 to stop after pressing the label conveying body 121 against the adhesive surface of the issued label 4.

In FIG. 2, the controller 140 allows the label conveying body 121 (string belts 124) to travel in the direction of the arrow in a state in which the label conveying body 121 (string belts 124) is away from the label holding unit 110 while a label 4 is issued. Further, when the curled front end portion of the label comes into contact with the label conveying body 121, the front end portion is fallen down in a direction where the label is issued. Accordingly, the curled front end portion of the label is sucked to the suction ports 111. Even in a case in which the curled front end portion is not sucked to the suction ports 111 since the label 4 is stiff, the label conveying body 121 traveling in the direction of the arrow approaches the adhesive surface of the label 4 while pushing down the curled front end portion to the suction ports 111. For this reason, even through a label 4 having a strong tendency to be wound is used, the front end portion of the label 4 is affixed to the label conveying body 121 without being folded inward. Accordingly, the label 4 having a strong tendency to be wound can be corrected.

Incidentally, since the bending of the issued label 4 is less in a case in which the diameter of a label roll wound in the form of a roll is large, such curl does not cause a problem. However, since the bending of the issued label 4 is large in a case in which the diameter of a label roll is small, there is a case where the curled front end portion may not be sucked to the suction ports 111.

In preparation for such a case, the label-affixing machine 100 includes a remaining amount detection unit 150 for a label roll loaded into the label printer 3. In a case in which a detected remaining amount is equal to or smaller than a predetermined value, the controller 140 performs control for controlling the drive of the pressing mechanism 130 and the label conveying body 121 to allow the label conveying body 121 to travel upward in a state in which the label conveying body 121 is away from the label holding unit 110 while a label 4 is issued and, once the issuing of the label ends, to allow the label conveying body 121 to stop after pressing the label conveying body 121 against the adhesive surface of the held label 4.

For example, in a case in which the conveying speed of a label 4 to be fed from the label roll is constant, the rotational speed of the label roll is increased as the diameter of the roll is reduced. Accordingly, the remaining amount detection unit 150 can be formed of a sensor configured to detect the rotational speed of the label roll at the time of issuing of a label. In this case, in a case in which the detected rotational speed is equal to or higher than a predetermined value, it is determined that the remaining amount of the label roll is equal to or smaller than a predetermined value. Further, instead of this structure, a proximity sensor for detecting the position of a label roll can also be provided at the outermost peripheral position of a label roll, of which the remaining amount is equal to or smaller than a predetermined value, to form the remaining amount detection unit 150. In a case in which such a structure is employed, the remaining amount of a label roll, which causes the curled front end portion to be folded, is tested in advance and the diameter of a label roll, which is slightly larger than the diameter of a label roll where there is a concern that the curled front end portion may be folded, is set as the above-mentioned predetermined value.

Furthermore, in the case of a label 4 that has a short length in the direction where the label is issued, many suction ports 111 not closed by the label 4 remain. For this reason, since a suction force is reduced, the curled front end portion may float from the suction ports 111.

Accordingly, in a case in which the length of a label in the direction where the label is issued is equal to or smaller than a predetermined value, the controller 140 controls the drive of the pressing mechanism 130 and the label conveying body 121 to allow the label conveying body 121 to travel upward in a state in which the label conveying body 121 is away from the label holding unit 110 while the label 4 is issued and, once the issuing of the label ends, to allow the label conveying body 121 to stop after pressing the label conveying body 121 against the adhesive surface of the label.

The length of the label in the direction where the label is issued in this case is, for example, the length of a label to be fed per label. The length of the label in the direction where the label is issued in this case can be obtained in a case in which the label printer 3 develops print information as two-dimensional image data. Accordingly, the length of a label to be fed, which is obtained in a case in which the above-mentioned control is needed, is obtained in advance through a test operation, and is registered as the predetermined value.

Since curl, which is caused by a tendency to be wound, occurs not only in the case of a label with a mount and but also in the case of a mountless label likewise, the above-mentioned control can be applied not only in the case of the label with a mount of FIG. 1 but also in the case of the mountless label of FIG. 2 likewise. However, in the case of the mountless label of FIG. 2, the label 4 to be cut and separated from the label roll needs to be held when the issued label 4 is cut by cutters 90. In a case in which the label 4 to be cut and separated from the label roll is not held, the label 4 cannot be cut at a normal boundary during the cutting of the label or the cut label 4 causes a position deviation.

For this reason, in a case in which the mountless label is used, the controller 140 controls the pressing mechanism 130 before the cutting of a label sheet 42 to press the label conveying body 121 against the adhesive surface of an issued label sheet 42. Accordingly, a label 4 can be cut and separated at a proper line.

Figure 15:
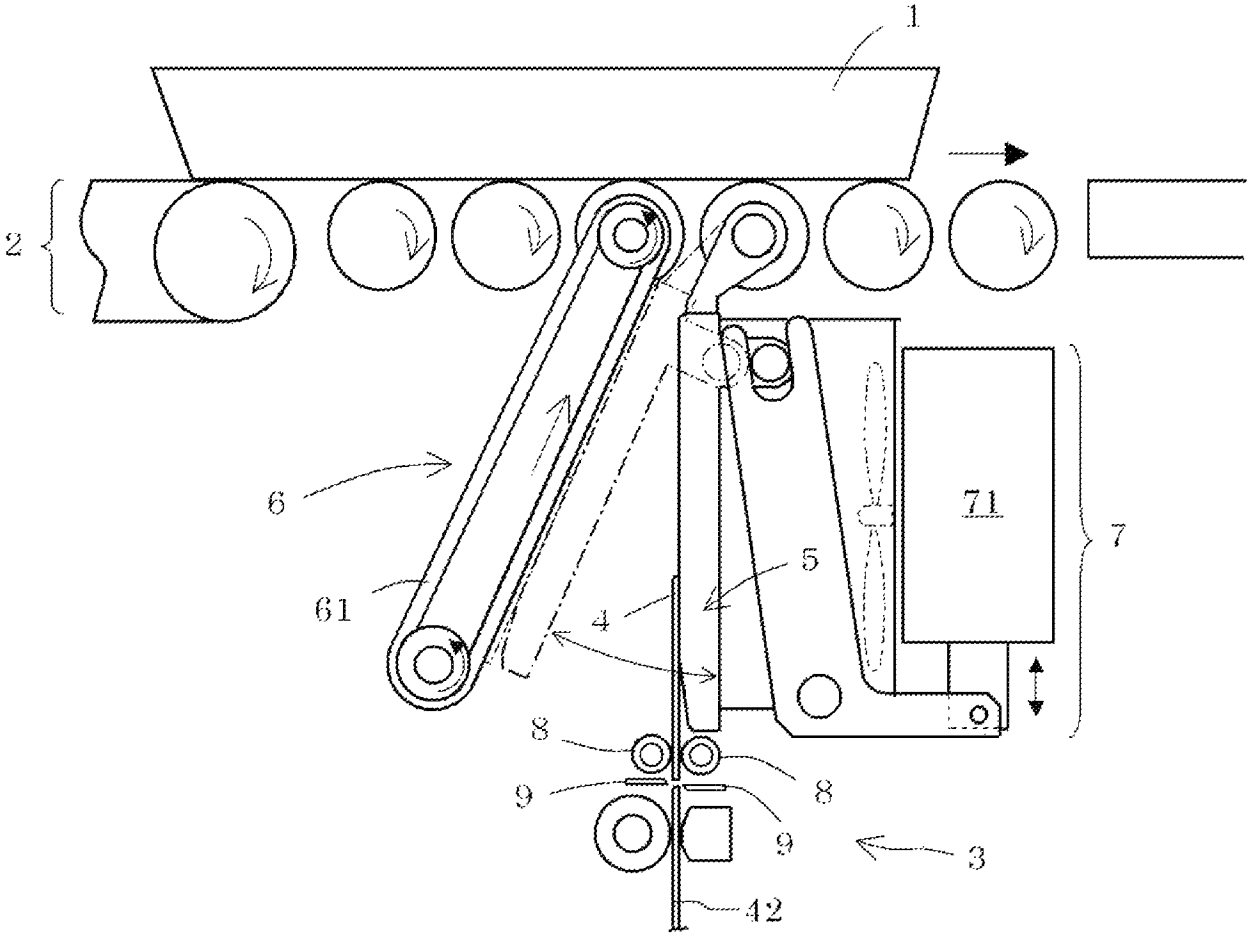
Fig.15 PRIOR ART
FIG. 15 is a diagram illustrating the structure of a machine in the related that uses a mountless label.

In FIG. 2, a pair of cutters 90 is provided above a print head 31 and a platen roller 32 that are disposed so as to face each other. In this case, a pair of rollers 8 of FIG. 15 illustrated as the related art is not necessary. Further, in a case in which a label 4 is to be cut from the issued label sheet 42, the label 4 is cut by the cutters 90 after the label conveying body 121 is pressed against the adhesive surface of the label sheet 42. Accordingly, the label 4, which is cut and separated from the label sheet 42, is affixed to and held by the label conveying body 121 without causing a position deviation.

Incidentally, the front end portion of a label to be issued from the label printer 3 is held by the label holding unit 110, but the rear end edge thereof remains at the separation position of a separation plate 33 of FIG. 1 or the cutting position of the cutters 90 of FIG. 2. For this reason, the front end portion of the issued label 4 takes various height positions according to the length of the label in the direction where the label is issued. In this case, since a distance where the front end portion of the label is conveyed until reaching the back surface of the product 1 varies, there is a trouble that feed control, which allows the front end portion of the label to touch the back surface of the product 1, should be changed according to the length of the label in the direction where the label 4 is issued.

For this reason, label sensors 43 and 44 for detecting the label 4 are provided at a predetermined position on the conveying path of the label conveying body 121, and the controller 140 allows the label conveying body 121 to be raised until the front end portion of the label 4 is detected by the label sensors 43 and 44 after the label conveying body 121 is pressed against the adhesive surface of the label 4. Accordingly, even though the length of a label in the direction where the label is issued is variously changed, the front end portion of the label can be made to remain at the detection position of the label sensors 43 and 44.

Photoelectric sensors, which detect that the label reaches in a case in which irradiation light is blocked by the label, can be used as the label sensors used in this case. A projector and an optical receiver are provided on the conveying path of a label at a predetermined position slightly below a position where a product 1 and the label 4 are to join each other, that is, at a position where irradiation light is blocked by the label 4 to be conveyed as illustrated in FIGS. 1 and 2, and the label sensors 43 and 44 are formed of the projector and the optical receiver. Further, after the label conveying body 121 is pressed against the adhesive surface of the label 4, the label conveying body 121 is raised. When the front end portion of the label is detected by the label sensors 43 and 44, the label 4 is stopped at the detected position.

Accordingly, even though the length of a label in the direction where the label is issued varies, the front end portion of the label 4 can always remain at a fixed position. Therefore, although one kind of control for sending the label conveying body 121 to the product 1 at a timing where the product 1 reaches a predetermined position is provided, labels 4 having different lengths in the direction where a label is issued can be affixed to a predetermined position on the back surface of a product.

The label-affixing machine 100 includes a conveyor 200 configured to convey a product 1, and a product detecting sensor 400 that detects the product 1 to be conveyed. The controller 140 allows the label conveying body 121 to travel upward in a case in which the controller 140 receives a product detection signal from the product detecting sensor 400.

Accordingly, when the product 1 to be conveyed reaches the detection position of the product detecting sensor 400, a label 4, which stands by at a predetermined position, is sent and is affixed to the back surface of the product 1. Therefore, even though the length of the product 1 in the conveying direction is changed, the label 4 can be affixed to a predetermined position on the back surface of the product.

Further, a stretch-wrapping machine includes a carry-out conveyor that sends a wrapped product 1 to the conveyor 200, and the carry-out conveyor and the conveyor 200 are connected to each other through a power transmission mechanism 212 to be described later. Accordingly, the carry-out conveyor of the wrapping machine and the conveyor 200 of the label-affixing machine can be operated at the same speed in synchronization with each other.

According to the above-mentioned label-affixing machine 100, since the label conveying body 121 is moved to the label holding unit 110 and conveys the label 4, which is held by the label conveying body 121, in the direction where the label is issued, the posture of the issued label 4 is not lost and the label can be affixed to the back surface of the product 1 just as it is even though not only a label with a mount but also a mountless label is used.

Further, even though a label of which the front end has a tendency to be curled is used, the curled front end portion of the label can be affixed to the label conveying body 121 while being pushed down in the direction where the label is issued. Accordingly, a label can be always affixed to the product 1 as a normal label 4 without a defect that the curled front end portion of the label is folded.

In addition, a label 4, which stands by at a predetermined position, is raised and is affixed to the back surface of the product 1 at a timing where a product 1 being conveyed reaches the detection position of the product detecting sensor 400. Accordingly, even though the length of a product in the conveying direction or the length of a label in the direction where the label is issued varies, a label 4 can be repeatedly affixed to a determined position on the back surface of the product.

Further, according to the stretch-wrapping machine, the conveyor, which sends a wrapped product 1 to the label-affixing machine 100, and the conveyor 200 of the label-affixing machine 100 can be operated at the same speed in synchronization with each other. Accordingly, affixing a label to a product 1 being conveyed is easily controlled, and a user can cope with a trouble after suspending the operation of the wrapping machine provided on the upstream side even though the trouble occurs in the label-affixing machine 100 provided on the downstream side.

An embodiment of the label-affixing machine and an embodiment of the stretch-wrapping machine on which the label-affixing machine is mounted will be described below with reference to FIGS. 3 to 13. Meanwhile, embodiments to be described below do not limit the scope of the invention.

[Structure of Entire Machine]

Figure 3:
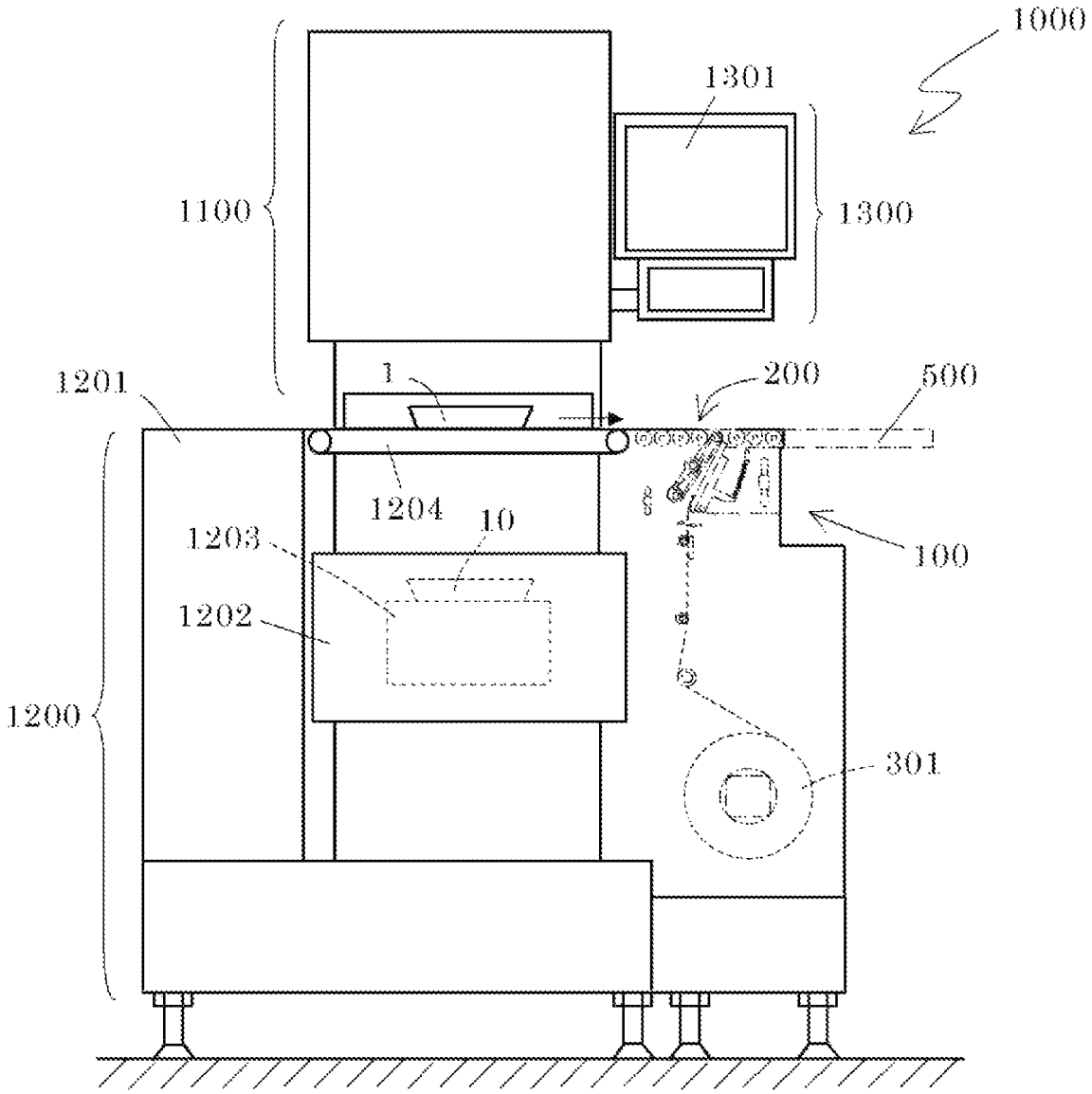
FIG. 3 is a front view of a stretch-wrapping machine according to an embodiment.
Figure 4:
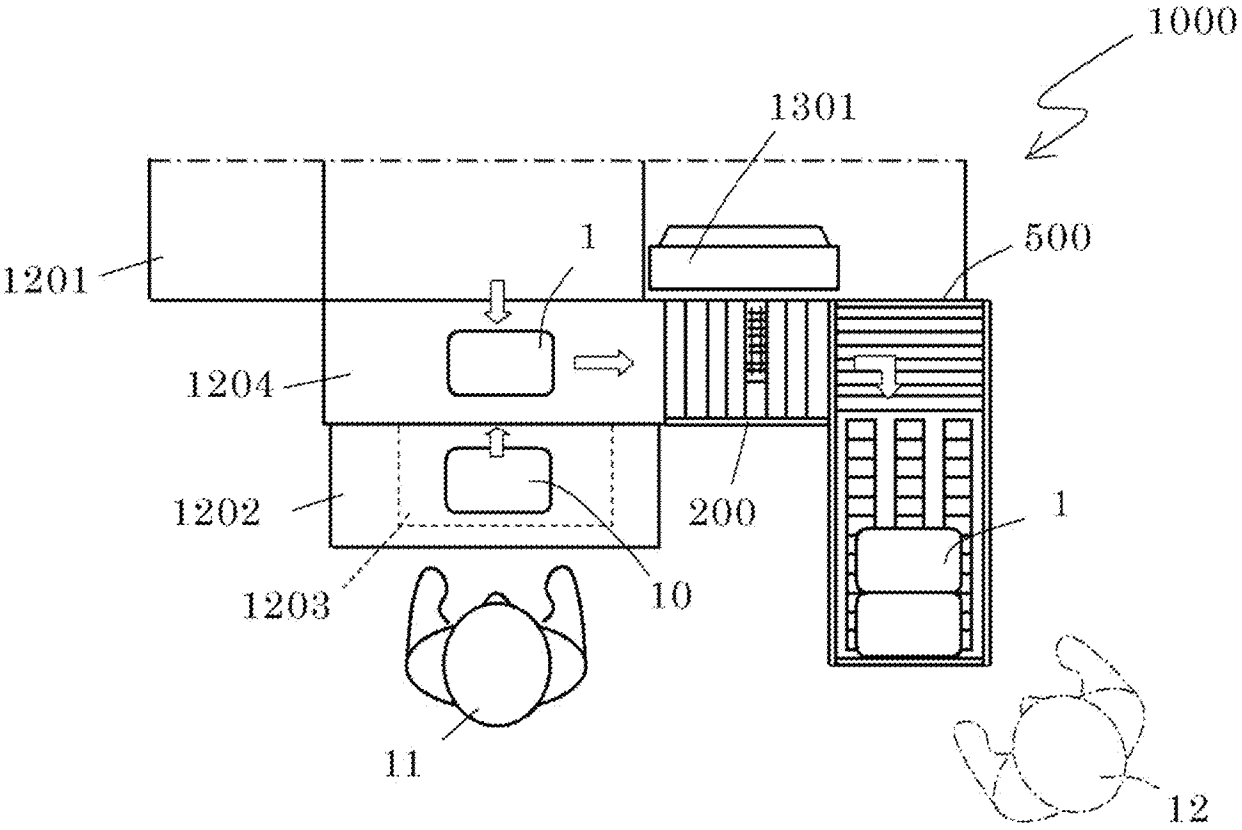
FIG. 4 is a plan view illustrating a side, which corresponds to a label-affixing machine, of the stretch-wrapping machine of FIG. 3.

In FIGS. 3 and 4, a stretch-wrapping machine 1000 as an embodiment includes an upper unit 1100, a lower unit 1200, and a control unit 1300. A label printer (not illustrated) that issues a price label and a label-affixing machine (not illustrated) that affixes the price label to the upper surface of a wrapped product 1 (product 1) are built in the upper unit 1100. A wrapping machine main body 1201 and a label-affixing machine 100 are built in the lower unit 1200; the wrapping machine main body 1201 wraps a product 10, which is stored in a tray or the like and is not yet wrapped, (unwrapped product 10) in a stretch film; and the label-affixing machine 100 is provided on the lateral side of the wrapping machine main body 1201 and affixes a label 4 to the back surface of the wrapped product 1. The control unit 1300 controls the respective units 1100 and 1200. The control unit 1300 includes the controller 140 and the remaining amount detection unit 150, which are illustrated in FIGS. 1 and 2, and an operation display unit 1301.

<Stretch-Wrapping Machine>

The wrapping machine main body 1201 includes a carry-in conveyor 1202 that is provided on the side facing a worker 11 of FIG. 4 and carries in the product 10 not yet wrapped. A weighing device 1203, which measures the mass of the product 10 not yet wrapped and outputs the measured mass to the operation display unit 1301, is built in the conveyor 1202. Further, when the measurement of mass performed by the weighing device 1203 ends, the carry-in conveyor 1202 is actuated and the product 10 placed on the carry-in conveyor 1202 is carried into the wrapping machine main body 1201.

The product 10, which is not yet wrapped and placed on the weighing device 1203, is processed food, such as fresh food, a side dish, or a packed lunch, stored on a tray. For this reason, the name, weight, price, and the like of a product are printed on a price label to be affixed to the upper surface of the wrapped product 1, and raw materials, additives, and the like having been used are printed on a label 4 to be affixed to the back surface of the product 1.

The wrapping machine main body 1201 is provided with a lift mechanism, a film conveying mechanism, a film holding mechanism, and a film folding mechanism that are not illustrated and are well known. The unwrapped product 10, which is carried into the wrapping machine main body 1201 by the carry-in conveyor 1202, is lifted from below toward a film, which is horizontally stretched by the film conveying mechanism and the film holding mechanism, by the lift mechanism. The lifted product 10 is pushed up while the film is stretched, and the peripheral edge portion of the film, which is formed into a chevron shape in this way, is folded to the back surface of the product 10 by the film folding mechanism. The product 1, which is wrapped in this way, is discharged to a carry-out conveyor 1204, which is provided on the front side, through a heater conveyor (not illustrated).

The carry-out conveyor 1204 is disposed above the carry-in conveyor 1202 so as to be orthogonal to the carry-in conveyor 1202. The conveyor 200, which forms a part of the label-affixing machine 100, and a stock conveyor 500 that temporarily stocks products 1 to which the labels are affixed are connected to the downstream portion of the carry-out conveyor 1204. The carry-out conveyor 1204 and the conveyor 200 of the label-affixing machine 100 are adapted to be operated at the same speed in synchronization with each other by being connected to each other through a power transmission mechanism 212 of FIG. 6. Further, products 1, which are stocked on the stock conveyor 500, are transferred to a wagon (not illustrated) or the like by a worker 11 or another worker 12, and are conveyed to a display zone in a store.

Since such a structure is well known, the detailed description thereof will be omitted here and a label-affixing machine 100 according to an embodiment will be described next.

[Label-Affixing Machine]

In FIGS. 5 to 8, the label-affixing machine 100 includes a conveyor 200 configured to convey a product 1 sent from the carry-out conveyor 1204, a label printer 300 that is disposed below the conveyor 200, a label holding unit 110 configured to hold a label 4 issued from the label printer 300 so that an adhesive surface of the label 4 faces outward, a pressing mechanism 130 (see FIG. 9) configured to press a label conveying body 121 against the adhesive surface of the held label 4, a conveying unit 120 configured to convey the label conveying body 121 to which the label 4 is affixed toward the product 1, and a controller 140 that controls the drive of the label conveying body 121 and the pressing mechanism 130.

<Conveyor>

Figure 6:
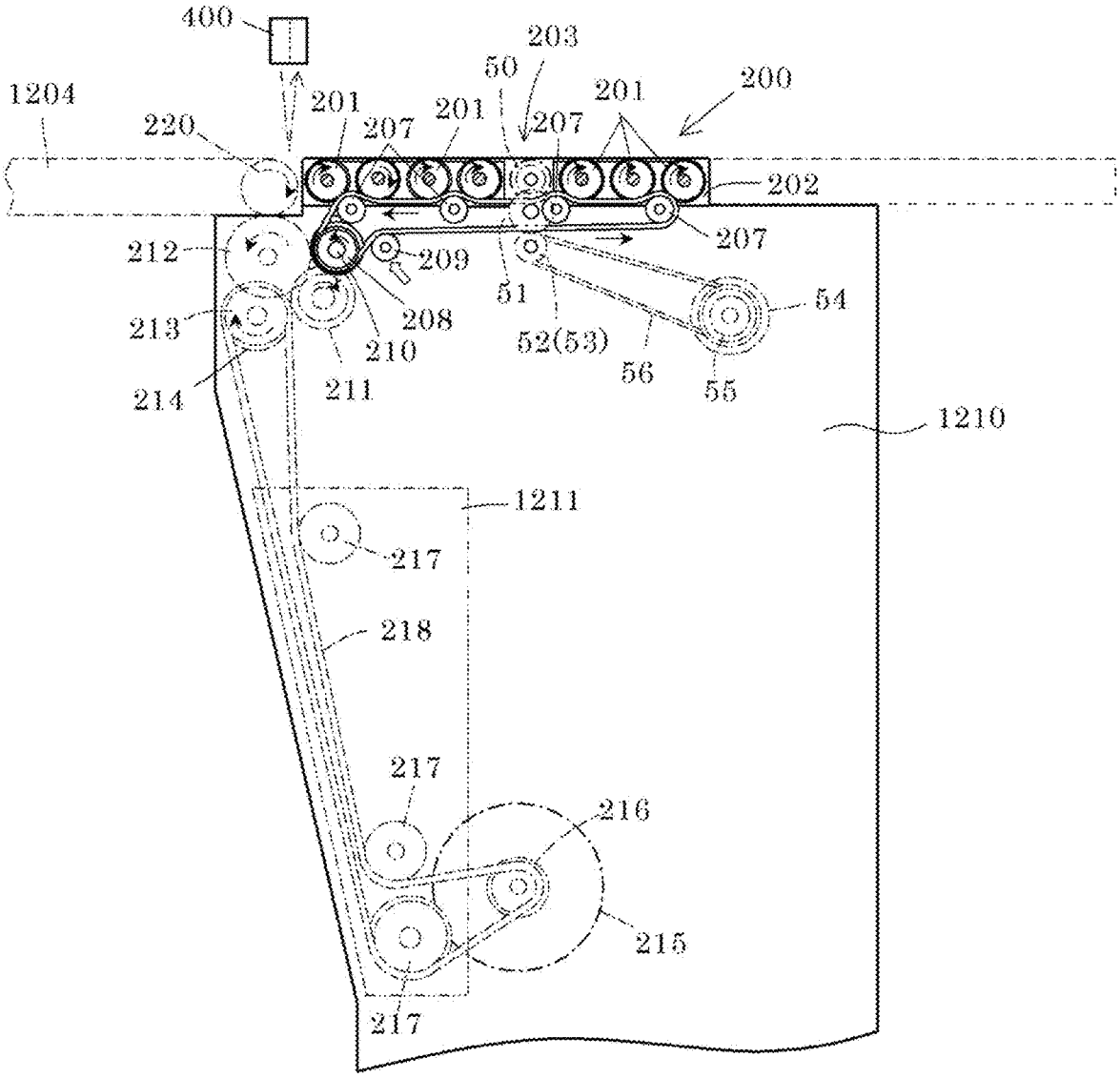
FIG. 6 is a schematic side view illustrating the structure of a drive system of the label-affixing machine of FIG. 5.
Figure 7:
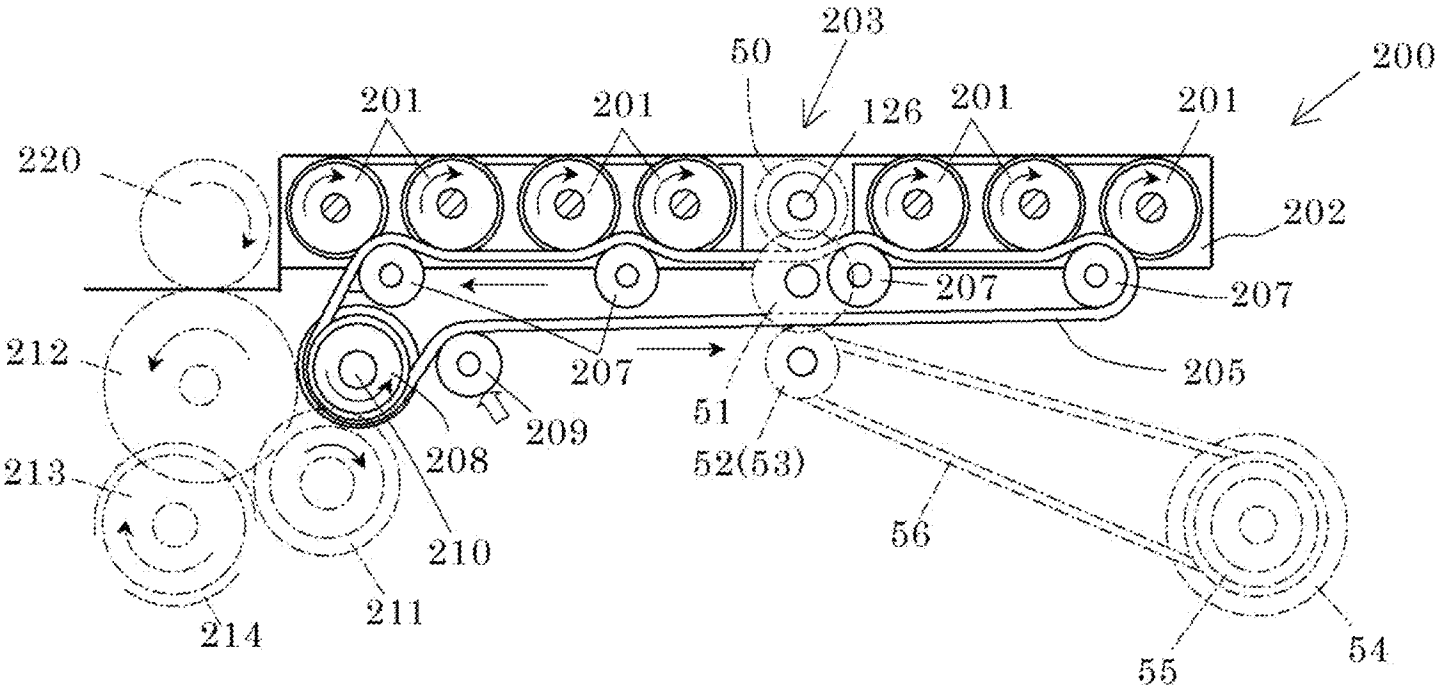
FIG. 7 is a side view enlarging and illustrating a part of FIG. 6.
Figure 8:
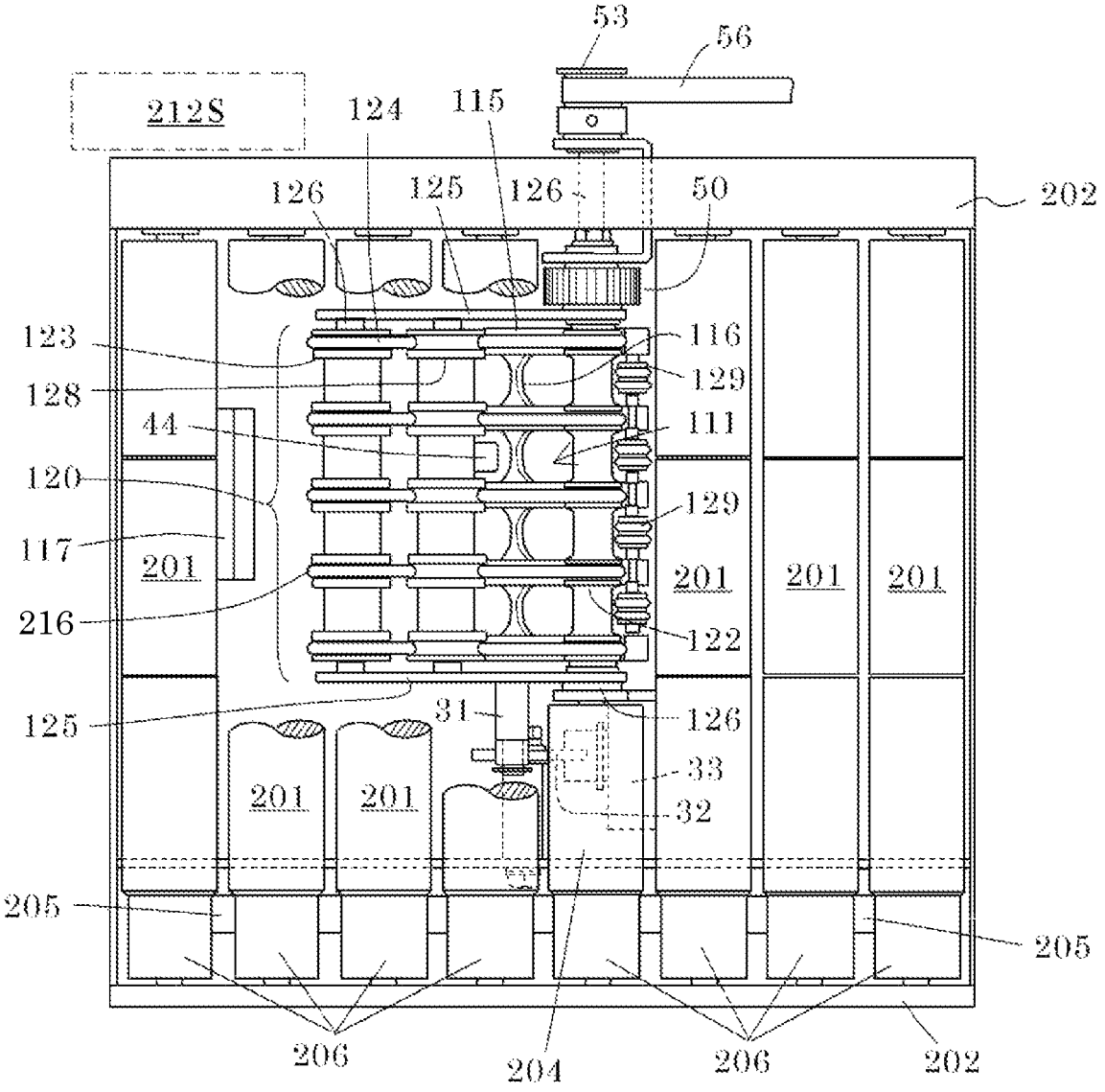
FIG. 8 is a schematic plan view illustrating a label conveying body and a label holding unit of the label-affixing machine of FIG. 5.

As illustrated in side views of FIGS. 6 and 7 and a plan view of FIG. 8, the conveyor 200 has a structure in which a plurality of rollers 201 are rotatably mounted on a frame 202 so as to be arranged in parallel. Each of the rollers 201 has a structure in which a shaft made of stainless steel is inserted into an aluminum pipe of which the surface is subjected to blasting. Further, an opening portion 203, which allows the upper end portion of the conveying unit 120 to be exposed to the outside, is formed substantially in the middle of the conveyor 200, and a roller 204, which fills a part of the opening portion 203, is formed to be shorter than the other rollers 201. A small-diameter drive roller portion 206, which is in contact with a drive belt 205 and is rotated, is coaxially formed at one end portion of each of the rollers 201 and 204.

<<Drive Belt>>

As illustrated in FIGS. 6 and 7, the drive belt 205 is adapted to be wound around a plurality of free rollers 207, which are disposed between the adjacent drive roller portions 206, and a main drive roller 208 under the drive roller portions 206 of the respective rollers 201 and to be rotated in the direction of an arrow. Further, the conveyor 200 is adapted to be detachably mounted on a main body frame 1210 of the label-affixing machine 100 from above, and the drive belt 205 is in close contact with the free rollers 207 and the drive roller portions 206 due to the own weight of the respective rollers 201 as illustrated in FIGS. 6 and 7 in a case in which the respective drive roller portions 206 are placed on the drive belt 205. Accordingly, the drive belt 205 applies torque to the respective drive roller portions 206 in the direction of an arrow. Furthermore, constant tension is applied to the drive belt 205 by a tension roller 209 that is biased by a spring. Accordingly, the drive belt 205 applies torque to the respective drive roller portions 206 while maintaining constant tension.

Moreover, the main drive roller 208 is mounted on one end portion of a rotating shaft 210 parallel to each roller 201, and a gear, which meshes with an idle gear 211, is mounted on the an end portion of the rotating shaft 210 opposite to the main drive roller 208. Accordingly, the idle gear 211 is disposed in a space 212S opposite to the drive roller portions 206 of FIG. 8. The idle gear 211 meshes with a drive gear 213 through a second idle gear 212, and a timing pulley 214 is mounted on the rotating shaft of the drive gear 213.

In addition, a timing belt 218 is wound the timing pulley 214 and a drive pulley 216 that is mounted on the rotating shaft of a motor 215, which is provided on the lower side, through tree guide rollers 217. Since the three guide rollers 217 are mounted on a movable plate 1211 that is movable relative to the main body frame 1210, the positions of the three guide rollers 217 relative to the drive pulley 216 of the motor 215 are changed in a case in which the movable plate 1211 is moved. Accordingly, tension is applied to the timing belt 218.

<<Power Transmission Mechanism>>

Further, the second idle gear 212 meshes with a gear 220 that drives the above-mentioned carry-out conveyor 1204. Accordingly, the second idle gear 212 serves as the power transmission mechanism 212 that transmits the torque of the conveyor 200 to the carry-out conveyor 1204. Furthermore, a gear ratio of the respective gears 211, 213, and 220 is set so that the conveying speed of the carry-out conveyor 1204 is equal to the conveying speed of the conveyor 200.

Meanwhile, the conveyor 200 of FIGS. 6 and 7 is adapted so that the drive roller portions 206 are placed on the drive belt 205, but may be adapted so that gears are mounted instead of the respective drive roller portions 206, idle gears are interposed between these gears, and the respective rollers 201 and 204 are rotated through the meshing of gears. However, it is easy to attach and detach the conveyor 200 from above in a case in which the drive belt 205 is used.

<<Product Detecting Sensor>>

A product detecting sensor 400, which detects a product 1 being conveyed, is provided above a carry-in port of the conveyor 200. The product detecting sensor 400 is formed of a proximity sensor that detects a product 1 in a non-contact manner.

<Label Printer>

Figure 5:
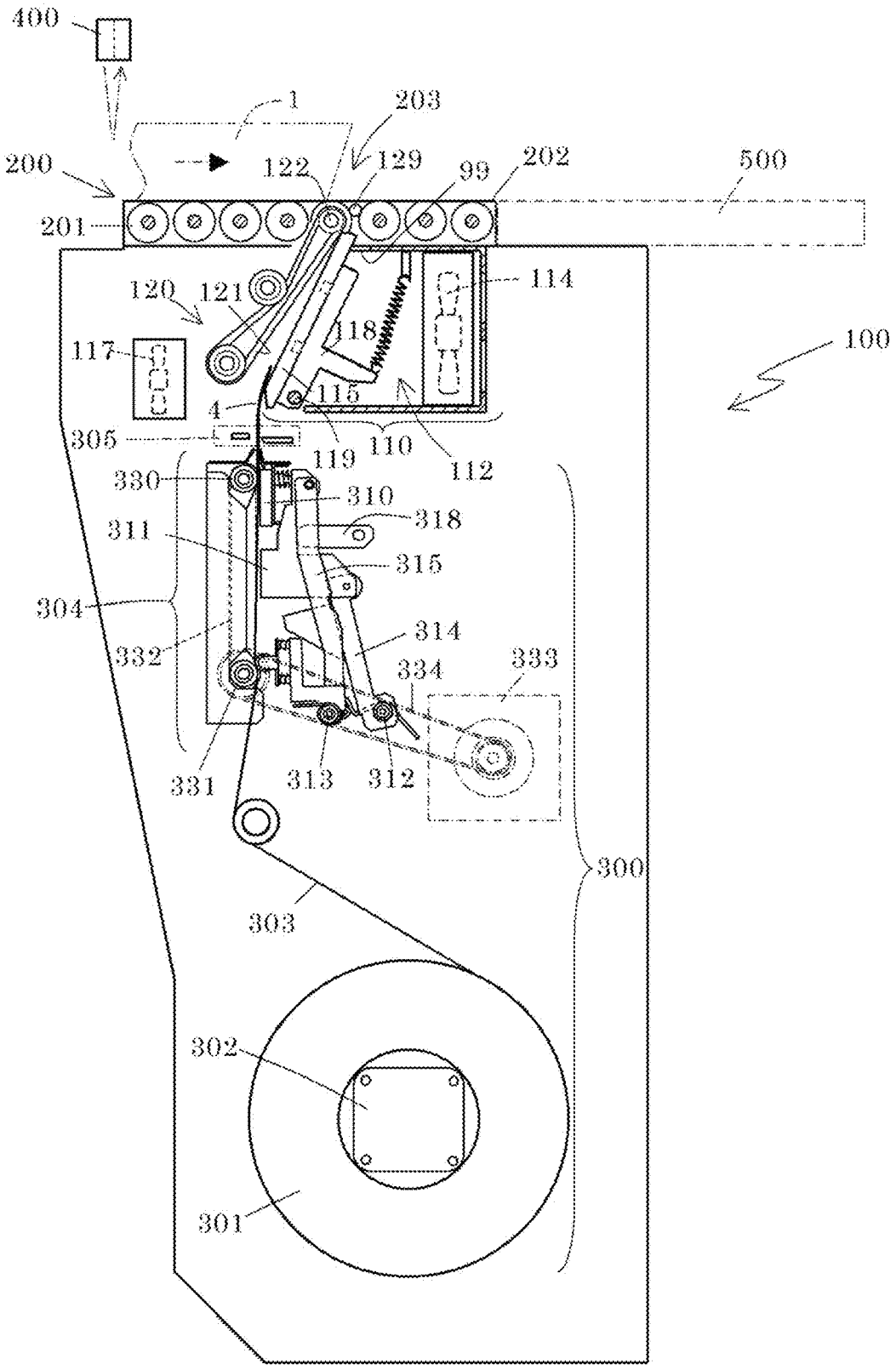
FIG. 5 is a schematic side view illustrating the structure of a label-affixing machine according to an embodiment.

The label printer 300 of FIG. 5 is adapted to use a so-called mountless label. The label printer 300 includes a loading unit 302 into which a label roll 301 is loaded, a Print unit 304 that prints predetermined items on a label sheet 303 fed from the label roll 301, and a cutter unit 305 that cuts the printed label sheet 303 into a predetermined length. The cutter unit 305 has a well-known structure, and includes a pair of cutters 90 illustrated in FIGS. 1 and 2, a crank mechanism (not illustrated) that linearly reciprocates one cutter of the cutters 90, and a rotary solenoid that rotationally drives the cutter.

<<Print

Figure 9:
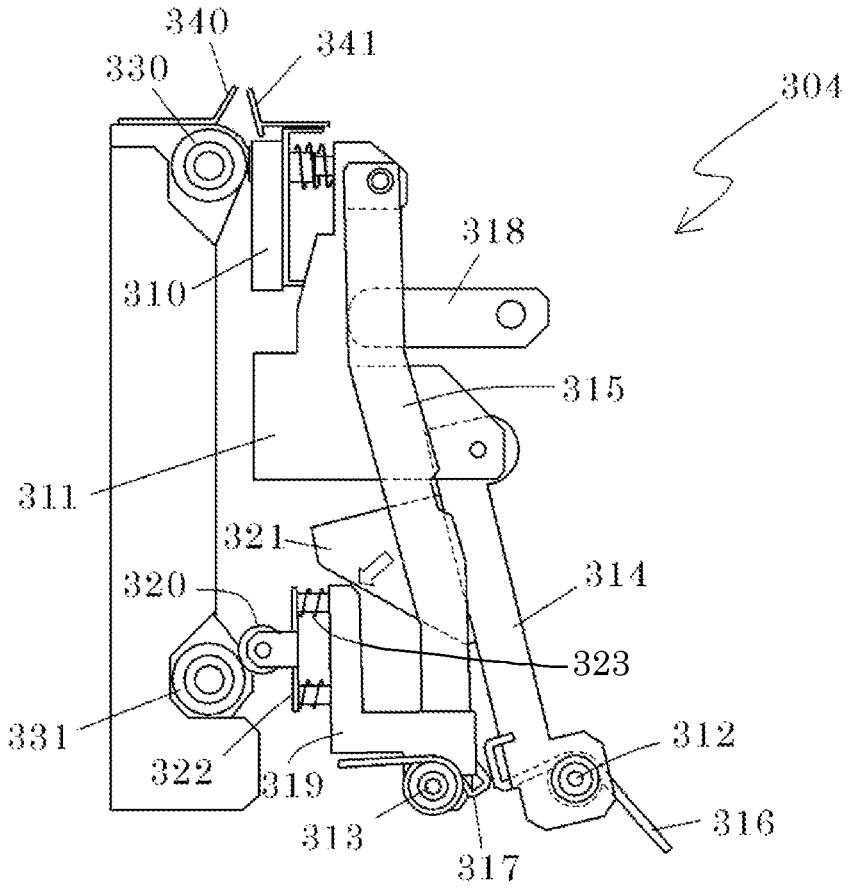
FIG. 9 is a side view illustrating main parts of a print unit of a label printer of the label-affixing machine of FIG. 5.
Figure 10:
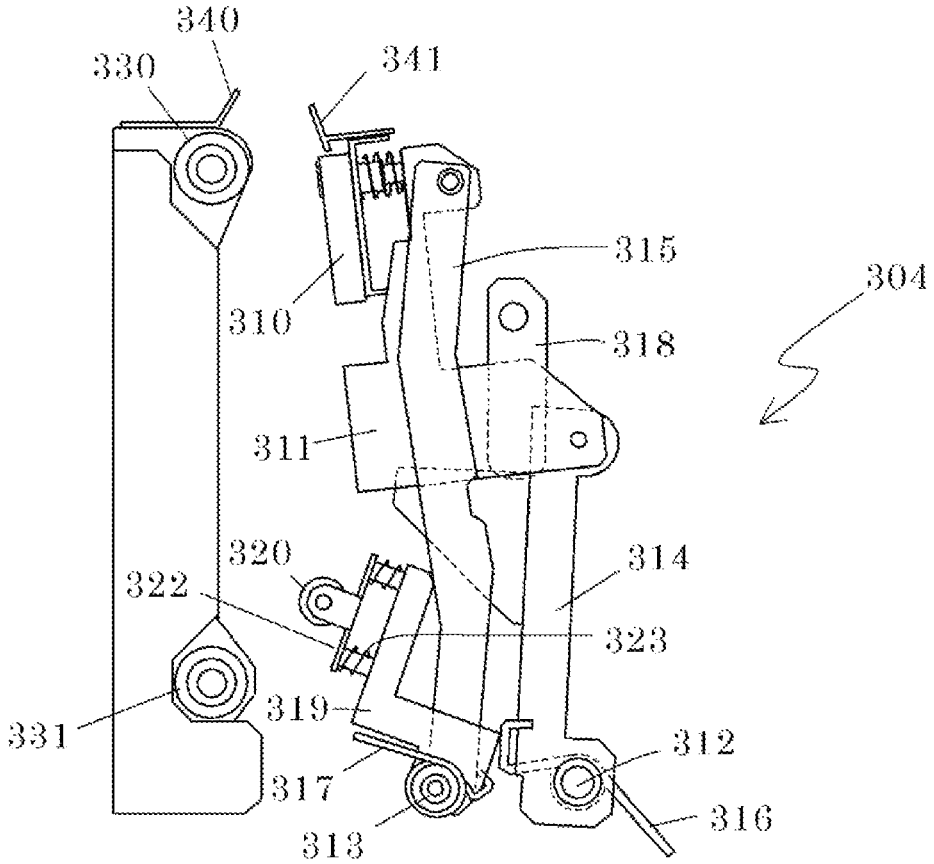
FIG. 10 is a side view illustrating a state in which the Print unit is opened at the time of the loading of a label sheet into the label-affixing machine of FIG. 5.

As illustrated in FIG. 9, the Print unit 304 includes a print head 310 and a platen roller 330 and the print head 310 is mounted on a connector part 311 of a four-joint rotation mechanism. The four joint rotation mechanism includes two fixed shafts 312 and 313, two levers 314 and 315 that oscillate around the respective fixed shafts 312 and 313, and the above-mentioned connector part 311 that is connected between the respective levers 314 and 315. Further, since the respective levers 314 and 315 are biased clockwise by torsion coil springs 316 and 317, a support bar 318 is horizontally maintained at the time of use to press the print head 310 against the platen roller 330 against the clockwise rotation of the respective levers 314 and 315. Further, in a case in which the support bar 318 is rotated downward to allow the label sheet 303 to pass between the print head 310 and the platen roller 330, the respective levers 314 and 315 are rotationally moved clockwise due to the elastic forces of the torsion coil springs 316 and 317 as illustrated in FIG. 10. As a result, a gap through which the label sheet 303 can pass is formed between the print head 310 and the platen roller 330.

As illustrated in FIG. 5, the platen roller 330 is connected to an assist roller 331, which is provided on the lower side, by a timing belt 332. The assist roller 331 is connected to the rotating shaft of a stepping motor 333 by a timing belt 334. Further, the platen roller 330 is adapted to steps by one dot line as the stepping motor 333 is driven.

As illustrated in FIGS. 9 and 10, an L-shaped bracket 319 is rotatably mounted on the fixed shaft 313, an auxiliary roller 320 is mounted on a vertical portion of the bracket 319 so as to face the assist roller 331, and the auxiliary roller 320 presses the label sheet 303 against the assist roller 331. Furthermore, when the print head 310 is in pressure contact with the platen roller 330, a triangular plate 321 mounted on the lever 314 of FIG. 9 presses the head portion of the bracket 319 in the direction of an arrow. Accordingly, the auxiliary roller 320 is pressed against the assist roller 331. Further, since the assist roller 331 is rotated by the drive of the stepping motor 333 of FIG. 5, the label sheet 303, which is pressed against the assist roller 331 by the auxiliary roller 320, is fed from the label roll 301. Meanwhile, a bearing bracket 322 of FIG. 10, which supports the auxiliary roller 320, is mounted on the L-shaped bracket 319 with coil springs 323 interposed therebetween so as to be close to and away from the L-shaped bracket 319.

A mountless label is loaded into the label printer 300. In this case, a label roll is loaded into the loading unit 302 so that the adhesive surface of the label sheet 303 is in contact with the platen roller 330. For this reason, guide plates 340 and 341 of which upper end portions are close to each other are provided at the upper portions of the print head 310 and the platen roller 330 as illustrated in FIGS. 9 and 10. Accordingly, a label 4 to be fed is guided upward in a vertical direction. Further, the guide plate 340, which is in contact with the adhesive surface of the label, is formed in the shape of a comb, so that the adhesive surface of the label does not adhere to the guide plate 340.

<Structure of Main Parts of Label-Affixing Machine>

Figure 11:
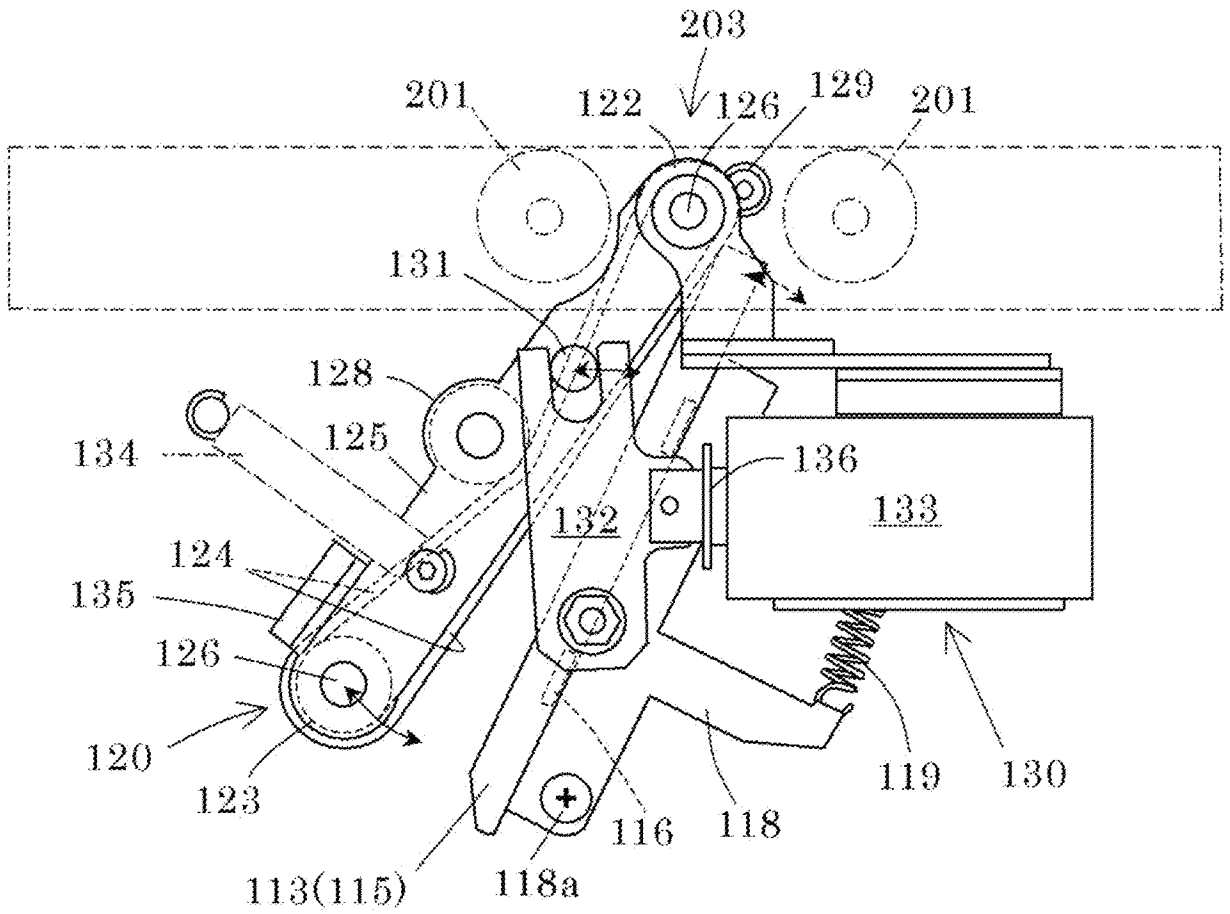
FIG. 11 is a schematic side view of a pressing mechanism of the label-affixing machine of FIG. 5.

In FIGS. 5 and 11, the label-affixing machine 100 includes the label holding unit 110 that holds a label 4 issued from the label printer 300 so that an adhesive surface of the label 4 faces outward, the pressing mechanism 130 that presses the label conveying body 121 against the adhesive surface of the held label 4, the conveying unit 120 that conveys the label conveying body 121 to which the label 4 is affixed toward the back surface of the product 1, and a controller 140 (see FIG. 12) to be described later that controls the drive of the label conveying body 121 and the pressing mechanism 130 on the basis of detection signals output from the label printer 300 and label sensors 43 and 44.

<<Label Holding Unit>>

The label holding unit 110 includes a negative-pressure chamber 112, a label holding body 113 that is provided on the side facing the conveying unit 120, and an exhaust fan 114 that reduces pressure in the negative-pressure chamber 112. The label holding body 113 includes sleighs 115 (see FIG. 11) that extend along the string belts 124 as the label conveying body 121 and connecting parts 116 that bridge the adjacent sleighs 115, and an area, which is surrounded by the sleighs 115 and the connecting parts 116, forms a suction port 111. Further, a label 4, which is issued from the label printer 300, is raised while being sucked to the suction port 111. However, in this case, to prevent the sliding label 4 from coming into contact with the connecting parts 116, the connecting parts 116 are provided at positions lower than the label sliding surfaces of the sleighs 115. Further, since the label 4 cannot slide on the sleighs 115 in a case in which the amount of air to be exhausted from the exhaust fan 114 is excessively large, the negative pressure in the negative-pressure chamber 112 is reduced to negative pressure that allows the front end portion of the label 4 not to sag down. Furthermore, an air blower 117, which applies air to the front end portion of the label 4 to be fed, is provided on the back side of the conveying unit 120, which is provided on the side facing the label holding body 113, to prevent the front end portion of the issued label from sagging down.

The label holding body 113 is fixed to a T-shaped bracket 118, and the bracket 118 is rotatably mounted on a machine frame through a hinge **118*a* that extends in a direction orthogonal to the plane of FIG. 11. Further, a coil spring 119, which rotationally moves the label holding body 113 counterclockwise about the hinge 118*a*, is mounted between an end portion of the bracket 118 in a horizontal direction and the machine frame. Accordingly, when a finger is put into a space between the label holding body 113 and the string belts 124 in a case in which a label is unexpectedly caught between the label holding body 113 and the string belts 124, the label holding body 113 is rotationally moved clockwise about the hinge 118*a*. As a result, the label caught between the string belts 124 and the label holding body 113 is removed by the finger. For this reason, the ceiling portion of the negative-pressure chamber 112 is provided with a cutout portion 99 that allows the oscillating label holding body 113 to avoid interfering with the negative-pressure chamber 112**.

<<Conveying Unit>>

In FIGS. 8 and 11, the conveying unit 120, which conveys the label conveying body 121, includes side frames 125, upper and lower rotating shafts 126 that are bridged between these side frames 125, a plurality of pulleys 122 and 123 to which these rotating shafts 126 are inserted and which are arranged side by side, a plurality of string belts 124 that are wound around these pulleys 122 and 123, and tension rollers 128 that press the respective string belts 124 from above. Further, a drive gear 50 of FIGS. 6 and 8, which is fixed to the upper rotating shaft 126, is connected to a power transmission mechanism to be described later, so that the upper rotating shaft 126 and the pulley 122 are rotated. Accordingly, the string belts 124 circularly travel between the respective pulleys 122 and 123.

The upper rotating shaft 126 faces the opening portion 203 formed at the conveyor 200, and the upper ends of the string belts 124 mounted on the upper rotating shaft 126 are mounted at positions slightly lower than the upper ends of the adjacent two rollers 201. Further, separation rollers 129, which separate the label 4 from the string belts 124, are mounted between the upper pulleys 122 that are arranged in a line. Furthermore, label sensors 43 and 44 are provided above the conveying unit 120 at a position where the inside of the negative-pressure chamber 112 is seen from the suction port 111. One label sensor 44 is formed of the label sensor 44 as an optical receiver illustrated in FIGS. 1 and 2, and a projector is provided in the negative-pressure chamber 112 facing the label sensor 44. Meanwhile, only the label sensor 44 as an optical receiver is illustrated in FIG. 8, but this label sensor 44 may be a projector. In this case, a label sensor provided in the negative-pressure chamber 112 is an optical receiver.

The power transmission mechanism, which meshes with the drive gear 50 of FIG. 8 and rotates the drive gear 50, is illustrated in FIGS. 6 and 7. In FIGS. 6 and 7, an idle gear 51 that meshes with the drive gear 50 and a drive gear 52 that meshes with the idle gear 51 and rotates the idle gear 51 are provided under the drive gear 50. Further, a pulley 53 is coaxially fixed to the rotating shaft of the drive gear 52, and a timing belt 56 is wound around the pulley 53 and a pulley 55 that is fixed to the rotating shaft of a motor 54. Then, when the motor 54 is driven, the drive gear 52 coaxial with the pulley 53 is rotated through the timing belt 56 and the pulley 53 and the drive gear 50 and the upper rotating shaft 126 of the respective pulleys 122 are simultaneously rotated through the idle gear 51 with the rotation of the drive gear 52.

<<Pressing Mechanism>>

In FIG. 11, the pressing mechanism 130 includes a pin 131 that is mounted on the side frames 125 of the conveying unit 120, a lever 132 of which one end pinches the pin 131 and the other end is rotatably mounted on the machine frame, and an electromagnetic solenoid 133 of which a movable core is joined to the lever 132 by a pin and allows the lever 132 to oscillate. Further, a coil spring 134, which pulls the side frame 125 clockwise, is provided between the side frame 125 and the machine frame (not illustrated) to return the lever 132 to an initial position, and the machine frame is further provided with a first stopper 135 that regulates the further clockwise rotation of the side frame 125.

Furthermore, when the electromagnetic solenoid 133 is actuated and the movable core is moved to the right, the lever 132 is rotationally moved clockwise, the pin 131 is also moved to the right, and the conveying unit 120 is rotationally moved counterclockwise about the upper rotating shaft 126. Then, when the string belts 124 come into contact with the label holding body 113, a second stopper 136, which is provided on the movable core, works and the string belts 124 are in close contact with the label holding body 113. Accordingly, in a case in which a label 4 is held by the label holding body 113, the adhesive surface of the label 4 is affixed to the string belts 124. When a controller 140 to be described later drives the motor 54 of FIG. 7 in this state, the string belts 124 travel and the label 4 affixed to the string belts 124 is conveyed upward.

<<Controller>>

Figure 12:
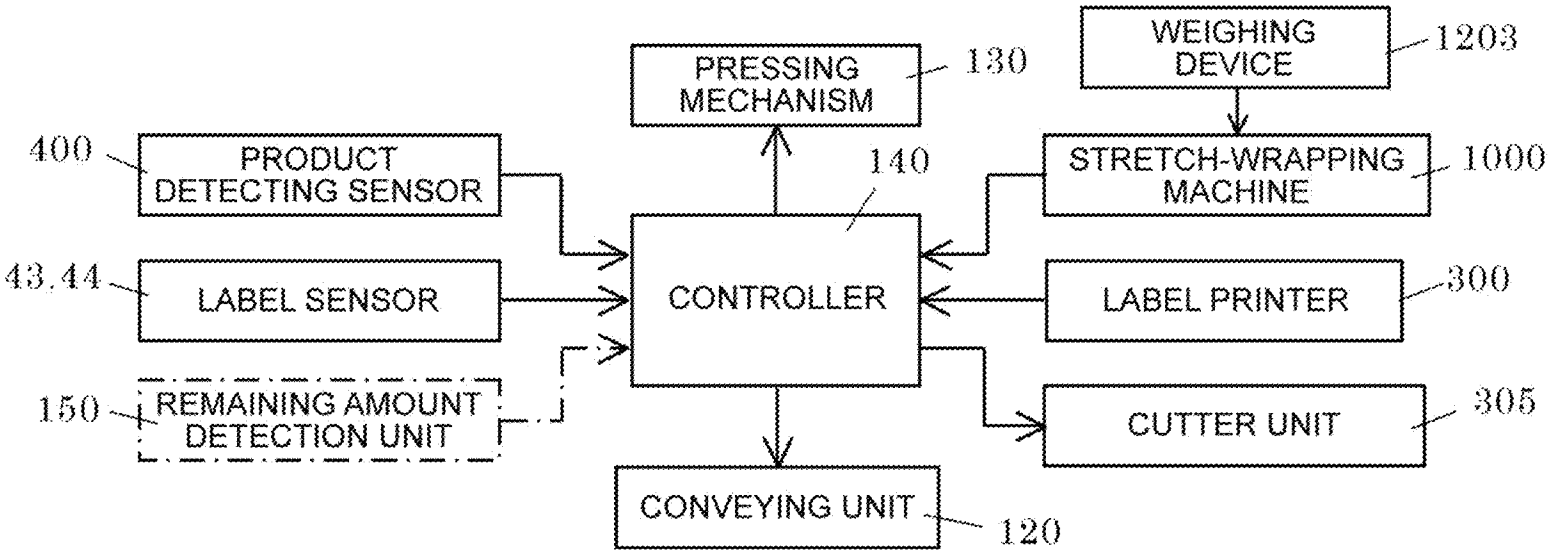
FIG. 12 is a block diagram illustrating the configuration of a control system of the label-affixing machine according to the embodiment.

FIG. 12 is a block diagram illustrating the configuration of a control system of the label-affixing machine 100. In FIG. 12, the controller 140 is formed of a computer and controls the drive of the label conveying body 121 and the pressing mechanism 130 by executing a program stored in an embedded memory. Further, a lift start signal is input to the controller 140 from the stretch-wrapping machine 1000, label length data and a printing completion signal are input to the controller 140 from the label printer 300, a signal informing that a product 1 being conveyed reaches a predetermined position is input to the controller 140 from the product detecting sensor 400, and a signal informing that a label 4 conveyed by the label conveying body 121 reaches a predetermined position is input to the controller 140 from the label sensors 43 and 44. Furthermore, in a case in which a weighing completion signal is input to the stretch-wrapping machine 1000 from the weighing device 1203, the carry-in conveyor 1202 is started, conveys an unwrapped product 10, which is placed on the weighing device 1203, to the lift mechanism, and stops. Subsequently, when the next unwrapped product 10 is placed on the weighing device 1203 and the weighing of the unwrapped product 10 is completed, the lift mechanism is started, a product 10 remaining on the lift mechanism is lifted, and the above-mentioned series of wrapping operations are performed.

<<Control of Drive of Label Conveying Body and Pressing Mechanism Performed by Controller>>

Figure 13:
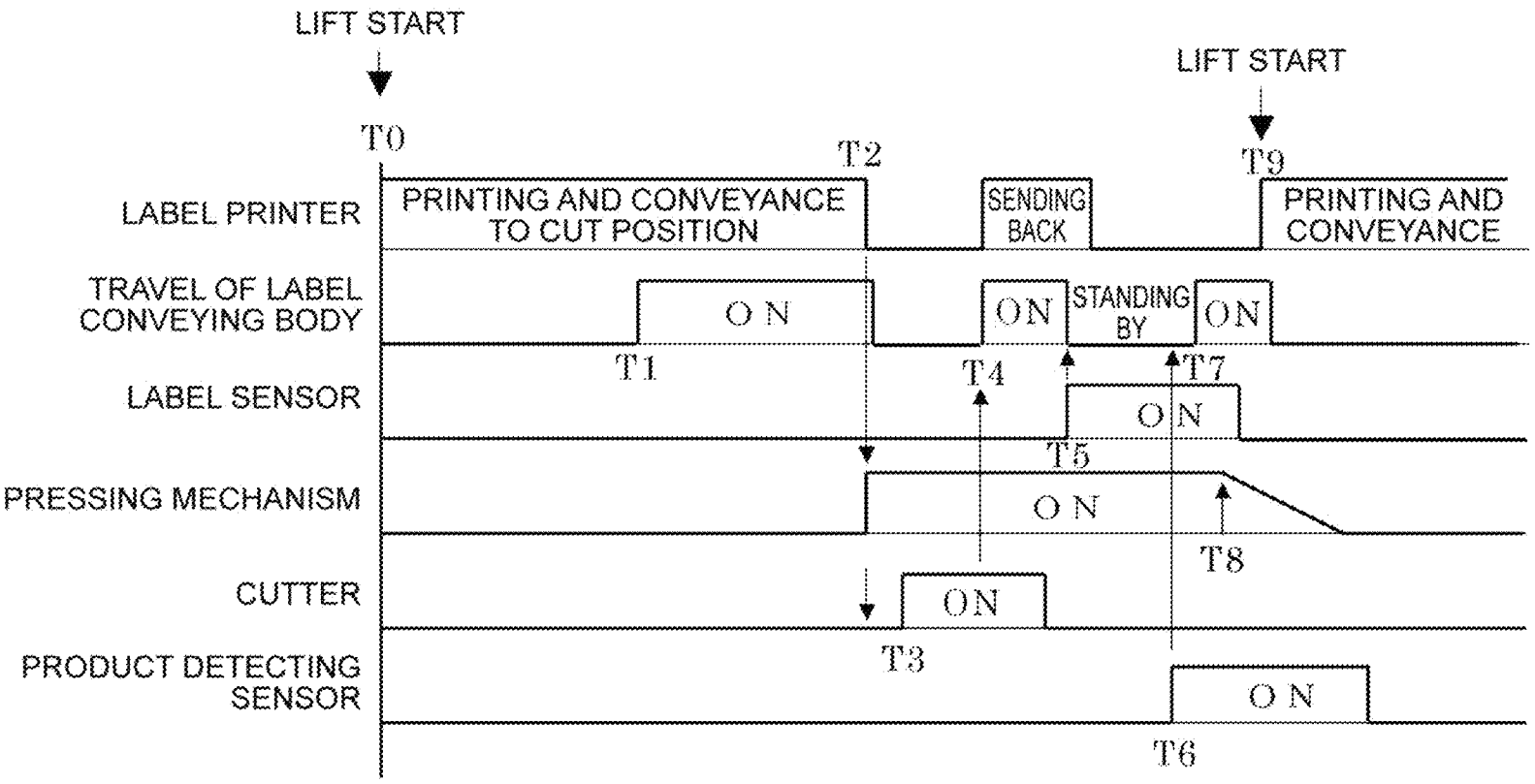
FIG. 13 is a timing chart illustrating the operation control of the control system of FIG. 12.
Figure 14:
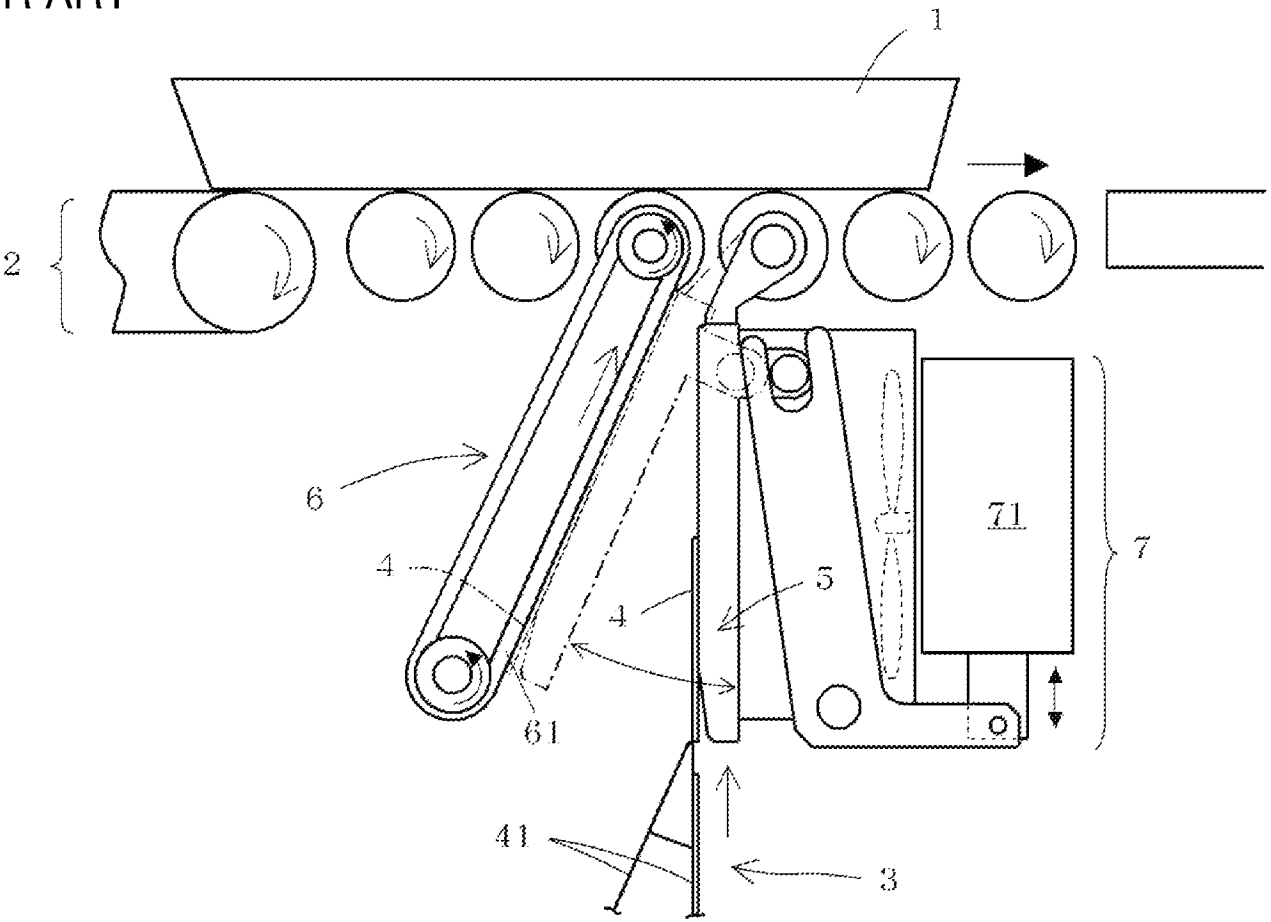
Fig.14 PRIOR ART
FIG. 14 is a diagram illustrating the structure of a machine in the related art that uses a label with a mount.

The controller 140 controls the drive of the label conveying body 121 and the pressing mechanism 130 on the basis of a timing chart of FIG. 13 from this lift start as a starting point. Meanwhile, a mountless label is loaded into the label printer 300. Immediately after the start, the label conveying body 121 is away from the label holding unit 110 and the exhaust fan 114 and the air blower 117 are operated.

In this timing chart, when the lift mechanism is started at a time T0, the label printer 300 prints predetermined items on a label sheet 303 while conveying the label sheet 303 from the start of the lift mechanism serving as a starting point. Then, the label sheet 303, which is fed from the guide plates 340 and 341, passes through the cutter unit 305, and the controller 140 allows the string belts 124 to travel at a time T1 when the front end portion of the label sheet 303 is sucked to the label holding body 113. At that time, the traveling string belts 124 are present at a position away from the label holding body 113. Accordingly, in a case in which the label is fed while the front end portion of the label sags down, the front end portion, which sags down, comes into contact with the string belts 124 and is raised while being fallen down toward the label holding body 113. Accordingly, the front end portion, which sags down, of the label is raised while being sucked to the label holding body 113.

In the meantime, the label sheet 303 is subjected to printing. When the printing ends, the label sheet 303 is further fed until a boundary portion between the preceding label and the following label reaches a cut position. Then, when the boundary position reaches the cut position, the label printer 300 stops the stepping motor 333 and subsequently outputs a printing completion signal to the controller 140.

Once the controller 140 receives the printing completion signal at a time T2, the controller 140 actuates the electromagnetic solenoid 133 of the pressing mechanism 130 to move the string belts 124 toward the label holding unit 110 and stops the travel of the string belts 124 after some delay. Accordingly, the label sheet 303, which is held by the label holding unit 110, is affixed to the string belts 124.

Subsequently, the controller 140 drives the cutter unit 305 at a time T3 when the string belts 124 are in close contact with the label holding body 113 and completely hold a label 4. Accordingly, the label sheet 303 is cut and a label 4 having a predetermined length is formed. Subsequently, the controller 140 allows the string belts 124 to travel again at a time T4 when the label sheet 303 is completely cut. Accordingly, the label 4 of which the rear end portion has been present at the cut position is conveyed upward. Meanwhile, the label printer 300 sends the label sheet 303 back at a time T4 when the label 4 is cut and separated from the label sheet 303 to return the overrun front end portion of the label sheet 303 to a print start position.

Then, the controller 140 stops the travel of the string belts 124 at a time T5 when the front end portion of the label 4, which is conveyed upward, is detected by the label sensors 43 and 44 and the signal thereof is input to the controller 140. Accordingly, the front end portion of the label, which is affixed to the string belts 124, is stopped at the detection position of the label sensors 43 and 44, that is, a position between the label sensor 43 as a projector and the label sensor 44 as an optical receiver that are illustrated in FIGS. 1 and 2.

While the stopped label 4 stands by at the detection position, a wrapped product 1 is sent to the conveyor 200 from the carry-out conveyor 1204. The product detecting sensor 400 detects the product 1 and outputs a detection signal to the controller 140 at a time T6 as that timing. Then, the controller 140 operates a timer from the time T6, and allows the string belts 124 to travel at a time T7 when the front end portion of the product 1 reaches the opening portion 203 of the conveyor 200. Then, since the label 4, which stands by immediately below the opening portion 203, protrudes obliquely upward from below, the label 4 is affixed to the back surface of the product 1 when the product 1 joins the label 4. In this case, it is preferable that the protruding speed of the label 4 and the conveying speed of the product 1 are set to the same value. However, in a case in which the conveying speed of the product is higher, the front end portion of the label 4 is pulled by the product 1 in a state in which the front end portion of the label 4 is affixed to the back surface of the product 1. Accordingly, at a timing T8 when the front end portion of the label reaches the back surface of the product 1, the electromagnetic solenoid. 133 of the pressing mechanism 130 is allowed to stop so that the string belts 124 float from the label holding body 113.

Subsequently, when the next product 10 is placed on the weighing device 1203 and the lift is started at a time T9 after the weighing of the product 10 is completed, the same operations as the above-mentioned operations are repeated.

In the above-mentioned operations, the string belts 124 are allowed to travel in a state in which the string belts 124 float from the label holding body 113 from an early stage where the issuing of one label does not yet end. The reason for this is to prevent the front end portion of a thin label or a label, which has a tendency to be wound, from sagging down, but there is a case where the sag of the front end portion of a firm label sheet or a label sheet having a large diameter of a roll may be prevented by the force of air from the exhaust fan 114 or the air blower 117. In such a case, the string belts 124 do not need to travel in advance from the time T1 of FIG. 13.

Further, in a case in which the diameter of a roll is reduced and the sag of the front end portion of a label cannot be prevented, the above-mentioned remaining amount detection unit 150 may be provided. In a case in which the detected remaining amount is equal to or smaller than a predetermined value, the controller 140 may control the drive of the pressing mechanism 130 and the label conveying body 121 to allow the label conveying body 121 to travel in a state in which the label conveying body 121 (string belts 124) float from the label holding unit 110 while a label is issued and, once the issuing of the label ends, to press the string belts 124 against the adhesive surface of the held label.

Furthermore, since the suction force of the suction port 111 is reduced in a case in which the length of a label in the direction where the label is issued is short, the front end portion of the label may sag down. In such a case, label length data is input to the controller 140 from the label printer 300. In a case in which the length of the label is smaller than a prescribed value, the controller 140 can control the drive of the pressing mechanism 130 and the label conveying body 121 to allow the string belts 124 to travel in a state in which the string belts 124 float from the label holding unit 110 while the label is issued.

The length of a label in the direction where the label is issued varies depending on a product, but print information at that time can be grasped in a case in which the label printer 300 reads necessary information from a memory and develops the necessary information into two-dimensional image information on the basis of a print format. Accordingly, depending on a product, the string belts 124 may be allowed to travel or not to travel in a state in which the string belts 124 float from the label holding body 113.

The embodiments of the invention have been described above. However, the invention is not limited thereto, and can also employ other embodiments.

For example, a mountless label has been used in the above-mentioned embodiments, but a label with a mount can also be used instead of the mountless label. In this case, a separation plate is provided instead of the cutter unit 305, and a take-up device for taking up a mount from which a label has been separated is added. Even in this case, the same structures as the structures of the embodiment can be applied to the label holding unit 110, the conveying unit 120, the pressing mechanism 130, and the controller 140.

REFERENCE SIGNS LIST

1: product, 4: label, 110: label holding unit, 120: conveying unit, 121: label conveying body, 124: string belts, 130: pressing mechanism, 140: controller, 150: remaining amount detection unit, 90: cutter, 100: label-affixing machine, 200: conveyor, 303: label sheet, 43: label sensor, 44: label sensor, 300: label printer, 400: product detecting sensor, 1000: stretch-wrapping machine, 1204: carry-out conveyor.

The invention claimed is:

1. A label-affixing machine configured to convey a label to a back surface of a product being conveyed, the label-affixing machine comprising:

a label holding unit configured to hold the label issued from a label printer so that an adhesive surface of the label faces outward;

a label conveyor disposed on a side facing the label holding unit to enable movement toward the label holding unit;

a pressing mechanism configured to press a conveying surface of the label conveyor against the label held by the label holding unit by moving the label conveyor toward the label holding unit; and a controller that controls drive of the label conveyor and the pressing mechanism to switch the label held by the label holding unit to the conveying surface of the label conveyor and affix the label to the back surface of the product.

2. The label-affixing machine according to claim 1, wherein the controller controls the drive of the label conveyor and the pressing mechanism to allow the label conveyor to be away from the label holding unit while the label is issued from the label printer and, once the issuing of the label ends, to press the conveying surface of the label conveyor against the adhesive surface of the label.

3. The label-affixing machine according to claim 1, wherein the controller controls the drive of the label conveyor and the pressing mechanism to allow the conveying surface to travel in a state in which the conveying surface of the label conveyor is away from the label holding unit while the label is issued from the label printer and, once the issuing of the label ends, to allow the label conveyor to stop after pressing the travelling conveying surface against the adhesive surface of the issued label.

4. The label-affixing machine according to claim 1, further comprising:

a remaining amount detection unit for a label roll that is loaded into the label printer, wherein in a case in which a detected remaining amount is equal to or smaller than a predetermined value of tendency to be wound remaining in the label, the controller controls the drive of the label conveyor and the pressing mechanism to allow the conveying surface to travel in a state in which the conveying surface of the label conveyor is away from the label holding unit while the label is issued from the label printer and, once the issuing of the label ends, to allow the label conveyor to stop after pressing the travelling conveying surface against the adhesive surface of the issued label.

5. The label-affixing machine according to claim 4, wherein in a case in which the length of the label in a direction where the label is issued from the label printer is a length that is difficult to hold by the label holding unit, the controller controls the drive of the label conveyor and the pressing mechanism to allow the conveying surface to travel in a state in which the conveying surface of the label conveyor is away from the label holding unit while the label is issued and, once the issuing of the label ends, to allow the label conveyor to stop after pressing the travelling conveying surface against the adhesive surface of the issued label.

6. The label-affixing machine according to claim 1, wherein the label printer includes a cutter configured to cut a label sheet into a length corresponding to the amount of printing.

7. The label-affixing machine according to claim 6, wherein in a case in which the cutter is actuated, the controller controls the pressing mechanism to cut the label sheet after pressing the conveying surface of the label conveyor against the adhesive surface of the label sheet to be cut.

8. The label-affixing machine according to claim 1, further comprising:

a label sensor configured to detect the label to be conveyed by the label conveyor during conveyance, wherein the controller controls the drive of the label conveyor and the pressing mechanism to allow the conveying surface to travel until the label is detected by the label sensor after the conveying surface of the label conveyor is pressed against the adhesive surface of the label.

9. The label-affixing machine according to claim 8, further comprising:

a product conveyor configured to convey the product; and a product detecting sensor configured to detect the product, wherein, once the controller receives a detection signal from the product detecting sensor, the controller allows the conveying surface of the label conveyor to travel to affix the label that remains at a detection position of the label sensor to the back surface of the product.

10. The label-affixing machine according to claim 9, comprising:

a carry-out conveyor configured to send a wrapped product to the product conveyor, wherein the carry-out conveyor and the product conveyor are connected to each other through a power transmission mechanism.

* * * * *